US011779052B2

(12) United States Patent
O'Connell

(10) Patent No.: US 11,779,052 B2
(45) **Date of Patent: *Oct. 10, 2023**

(54) TOBACCO PRODUCT COMPOSITIONS AND DELIVERY SYSTEM

(71) Applicant: HZAT, LLC, Miami, FL (US)

(72) Inventor: Thomas O'Connell, Sunny Isles Beach, FL (US)

(73) Assignee: HZAT, LLC, Miami, FL (US)

( * ) Notice: Subject to any disclaimer, the term of this patent is extended or adjusted under 35 U.S.C. 154(b) by 169 days.

This patent is subject to a terminal disclaimer.

(21) Appl. No.: 17/313,770

(22) Filed: May 6, 2021

(65) Prior Publication Data

US 2021/0251288 A1 Aug. 19, 2021

Related U.S. Application Data

(63) Continuation of application No. 17/079,186, filed on Oct. 23, 2020, now Pat. No. 11,000,064, which is a (Continued)

(51) Int. Cl.
*A24F 47/00* (2020.01)
*A24F 40/42* (2020.01)
(Continued)

(52) U.S. Cl.
CPC ..... *A24F 40/42* (2020.01); *A24B 15/167* (2016.11); *A24F 40/10* (2020.01); *A24F 40/50* (2020.01)

(58) Field of Classification Search
CPC ..... A24F 40/10; A24F 40/20; A24F 40/42; A24F 40/46; A24F 40/50
See application file for complete search history.

(56) References Cited

U.S. PATENT DOCUMENTS 8,479,747 B2 7/2013 O'Connell
10,653,180 B2 5/2020 Monsees et al.
(Continued)

FOREIGN PATENT DOCUMENTS

CN 106037011 A 10/2016
CN 108323812 A 7/2018
(Continued)

OTHER PUBLICATIONS

International Search Report and Written Opinion for International Application No. PCT/US2020/039911 dated Sep. 4, 2020. (Previously submitted in related U.S. Appl. No. 16/913,477).
(Continued)

*Primary Examiner* — Eric Yaary
(74) *Attorney, Agent, or Firm* — Gardella Grace P.A.

(57) ABSTRACT

In an illustrative embodiment, a heat-not-burn tobacco aerosolization device aerosolizes a high viscosity, wet tobacco product at a very low temperature and reduces harmful and potentially harmful carcinogen (HPHC) emissions by six times or more relative to conventional heat-not-burn products while also providing substantially improved taste and user experience. Embodiments exemplified herein provide a compelling and healthier substitute for cigarette smoking that avoids the HPHC emissions of conventional heat-not-burn products while also avoiding the increased risk of addiction and short-term health effects reported in connection with conventional vaping devices.

20 Claims, 22 Drawing Sheets

Related U.S. Application Data continuation of application No. 16/913,477, filed on Jun. 26, 2020, now Pat. No. 10,820,629.

(60) Provisional application No. 63/022,160, filed on May 8, 2020, provisional application No. 62/867,416, filed on Jun. 27, 2019, provisional application No. 62/867,409, filed on Jun. 27, 2019.

(51) Int. Cl.

| | |
|---|---|
| ***A24B 15/167*** | (2020.01) |
| ***A24F 40/50*** | (2020.01) |
| ***A24F 40/10*** | (2020.01) |

(56) References Cited

U.S. PATENT DOCUMENTS

| | | | |
|---|---|---|---|
| 10,820,629 | B1 | 11/2020 | O'Connell |
| 11,000,064 | B2 | 5/2021 | O'Connell |
| 11,234,464 | B2 | 2/2022 | Qiu |
| 2015/0150302 | A1 | 6/2015 | Metrangolo et al. |
| 2015/0208729 | A1 | 7/2015 | Monsees et al. |
| 2015/0272216 | A1 | 10/2015 | Dai et al. |
| 2016/0058066 | A1 | 3/2016 | Banks et al. |
| 2016/0073695 | A1 | 3/2016 | Sears et al. |
| 2016/0120225 | A1 | 5/2016 | Mishra et al. |
| 2016/0338412 | A1 | 11/2016 | Monsees et al. |
| 2017/0360095 | A1 | 12/2017 | Batista |
| 2018/0029782 | A1 | 2/2018 | Zuber et al. |
| 2018/0049469 | A1 | 2/2018 | Kaufman et al. |
| 2018/0297048 | A1 | 10/2018 | Ricketts et al. |
| 2019/0045834 | A1 | 2/2019 | Fuisz et al. |
| 2019/0166904 | A1 | 6/2019 | Lang |
| 2021/0037885 | A1 | 2/2021 | O'Connell |

FOREIGN PATENT DOCUMENTS

| | | |
|---|---|---|
| CN | 109330038 A | 2/2019 |
| EP | 3989746 | 12/2020 |
| WO | 2014/004648 | 1/2014 |
| WO | 2014/116974 | 7/2014 |
| WO | 2016/096728 | 6/2016 |
| WO | 2016171997 | 10/2016 |
| WO | 2020/264362 | 12/2020 |

OTHER PUBLICATIONS

St Helen, et al., "IQOS: Examination of Philip Morris International's Claim of Reduced Exposure", Tobacco Control 27, Suppl 1 (2018): s30-s36. (Previously submitted in related U.S. Appl. No. 16/913,477).

Bai, David, "Flavorants and Propylene Glycol From e-Cigarettes Form Harmful Irritants When Combined", AJMC, Nov. 2, 2018. (Previously submitted in related U.S. Appl. No. 16/913,477).

Partial Supplementary European Search Report mailed in EP Application No. 20832320.4 dated Jul. 27, 2022.

TOBACCO PRODUCT COMPOSITIONS AND DELIVERY SYSTEM

RELATED APPLICATIONS

This application is a continuation of and claims the benefit of priority to U.S. patent application Ser. No. 17/079,186 filed Oct. 23, 2020, (to be issued as U.S. Pat. No. 11,000,064) which is a continuation of and claims the benefit of priority to U.S. patent application Ser. No. 16/913,477 filed Jun. 26, 2020, (now U.S. Pat. No. 10,820,629) which claims priority to U.S. Provisional Patent Application Serial Nos. 63/022,160 filed May 8, 2020, 62/867,409, filed Jun. 27, 2019, and 62/867,416, filed Jun. 27, 2019, each of which is hereby incorporated by reference in its entirety.

INCORPORATION BY REFERENCE

Each document cited herein is incorporated by reference in its entirety for all purposes.

BACKGROUND

The use of e-cigarettes or vaping mechanisms have gained popularity in the last several years as an alternative mode of delivering nicotine to end-users. The e-cigarettes or related products currently on the market typically comprise a housing or pod with a heating element connected to a metal conductor used to vaporize or create an aerosol of a nicotine juice mixture for users to inhale. The resulting vapor or aerosol is usually the byproduct of nicotine or nicotine juice mixture, flavorant, and solvents. The e-cigarette and vaping device methods tend to deliver a "smoking experience" without the true tobacco taste and flavor. Thus, while somewhat safer than smoking traditional tobacco products, the experience is much less satisfying than would be experienced with a traditional, cigarette-type product.

One value of traditionally produced tobacco that is missing from current vaping devices is the complex flavor imparted by the cured, prepared tobacco. Over hundreds of years, the tobacco industry has developed protocols for producing desirable and complex flavors by such means as tobacco plant breeding, specific tobacco crop growing methods, harvesting methods, and various tobacco curing processes, for consumer products that deliver the user a specific flavor upon inhalation. These products include, for example, cigarettes, cigars, snuff, dip, snus, pipe tobacco, and other products. This complexity of the flavors during the inhalation experience is often missing or masked by flavorants in modern e-cigarette and inhalation devices.

As another alternative to traditional cigarettes, hookah devices utilize heat (such as charcoal heat) to create tobacco vapor that passes through a water container prior to inhalation. Typically, the tobacco product used in these devices is termed "shisha." These hookah or shisha devices can include one hose outlet, or several hose outlets so that multiple consumers can use the device at the same time. The tobacco used in shisha devices may be mixed with other ingredients, to alter the flavor or smoke production characteristics of the device.

In recent years a new category of tobacco product has emerged: "heat-not-burn." As early as 1994, R.J. Reynolds Tobacco had introduced the Eclipse line of heat-not-burn cigarette products and since the mid-1990s additional heat-not-burn systems were commercialized and marketed to smokers. Heat-not-burn tobacco products heat the tobacco enough to warm it but not to burn it, often using a batterypowered heating system. As the heating system begins to heat the tobacco, it generates an aerosol that contains nicotine and other chemicals that is inhaled. Gases, liquid and solid particles, and tar are usually found in the emissions of conventional heat-not-burn products. Heat-not-burn products often contain additives not found in tobacco and are frequently flavored. Heat-not-burn products typically heat tobacco leaves at a lower temperature than traditional cigarettes, typically about 250-400° C. instead of 500° C. or higher at which tobacco combustion occurs.

In contrast to heat-not-burn tobacco products, vaping products typically operate by providing a nicotine-containing liquid in a reservoir that includes a wicking system to draw the liquid into an air passage. As shown in U.S. Pat. No. 10,653,180 assigned to Juul Labs, a portion of which has been reproduced as FIG. 5, the cartridge 14 includes two compartments 114, 214 which contain liquid soaked batting 6, 7. A silica wick 9 draws the nicotine containing liquid into the air passage 26 and into contact with a heating element 31. The heating element aerosolizes the nicotine containing fluid, which is produces an inhalable aerosol form.

Typical heating element temperatures in conventional vaping devices are from about 150-230° C. Such aerosolization temperatures are lower than typical heat-not-burn devices and for this reason vaping devices typically produce fewer and less concentrated harmful and potentially harmful constituents (HPHCs). Based on data published by a leading tobacco company, a reduction of the aerosolization temperature from 300° C. to 200° C. reduces HPHCs by a factor of two, whereas reduction of the aerosolization temperature from 300° C. to 100° C. reduces HPHCs by a factor of four, five or six.

One substantial disadvantage of vaping products is that they contain an increased concentration of nicotine and flavorants relative to cigarettes. One Juul cartridge, called a pod, has roughly the equivalent amount of nicotine as one pack of cigarettes. That increased nicotine concentration carries with it a possible increased risk of addiction. Vaping also has been reported to have adverse short-term health effects such as rapid deterioration of vascular function, increased heart rate, and elevated diastolic blood pressure.

Returning to conventional heat-not-burn devices, they include delivery systems designed to heat a mixture of nicotine juice, flavorant, and other additives in order to convert it into vapor/smoke for inhalation by an end-user. The heat-not-burn devices currently on the market are limited in that they cannot be used with unaltered real leaf tobacco. Such devices often utilize scraps and fines of a tobacco plant that is formed into a reconstituted or homogenized tobacco sheet such as that shown in FIGS. 1A and 1B, which does not retain a high tobacco content of leaf tobacco after processing and is altered chemically.

One particularly popular heat-not-burn device is IQOS, marketed by Philip Morris International under the Marlboro and Parliament brands and described in U.S. Published Patent Application No. 2015/0150302A1. The IQOS product consists of a charger around the size of a mobile phone and a holder that looks like a pen. The disposable tobacco stick, called a HeatStick, is described as a mini-cigarette. The sticks contain dry processed reconstituted tobacco that has been soaked in propylene glycol and dried to a target moisture level. The mini-cigarette is inserted into the holder which then heats the rolled dry tobacco sheet product to temperatures up to 350-400° C.

The interface of the IQOS mini-cigarette and holder are illustrated in FIG. 2. The holder 201 includes a heating blade 202 to heat a rod of dry tobacco product 203 that has been soaked in propylene glycol and formed of rolled sheets of tobacco as shown in FIGS. 1A-1B. A user draws on the mouth-end 204 of the mini-cigarette and the tobacco is heated to a temperature of about 375° C. At this temperature, volatile compounds are evolved from the two different sheets of cast-leaf tobacco of the rod 203. These compounds condense to form an aerosol. The aerosol is drawn through the filter (also indicated by reference number 204) and into the user's mouth.

The combination of relatively high heat (350 to 400° C.) and aerosolized propylene glycol produces a relatively thick vapor and more robust flavor than certain vaping products. However, the increased heat also increases the concentration of HPHCs. IQOS achieves only about an 80% reduction of HPHCs (known carcinogens) relative to cigarette smoking. At lower temperatures, substantially higher HPHC reductions of 90% or more could be achieved.

Moreover, propylene glycol as a moisture carrier for the reconstituted sheet is synthetic and may present certain risk factors compared to a natural glycerin. Glycerin is a non-toxic fluid made from plant oils in its natural form. Propylene glycol, in contrast, is a synthetic fluid that derives from propylene oxide. While it is recognized as a generally safe chemical for human use in liquid form, due to its more toxic behavior than glycerin the amount of propylene glycol in a product is typically small. Trace amounts of propylene glycol can be found in many products, as it does not react on its own and does not affect other ingredients. However, when propylene glycol is heated it may change the chemical composition and produce propylene oxide which is known as a carcinogen. Accordingly, the IQOS product may produce unhealthy levels of propylene oxide because of the unique manner in which it heats dry tobacco containing propylene glycol to a relatively high temperature of 350° C. or more.

The IQOS product includes numerous synthetic ingredients that are added in an attempt to provide acceptable taste. According to Philip Morris' website, its heated tobacco products such as IQOS Heatsticks include numerous additives, listed in Table 1 below, added to the tobacco in the version sold in the United Kingdom. The additive information for the version of IQOS Heatstick sold in the United States is not provided.

TABLE 1

| | Maximal use level (% in the tobacco) | Function | CAS |
|---|---|---|---|
| 2,4-heptadienal | 0.001 | flavouring | 4313-03-5 |
| 2-heptanone | 0.0001 | flavouring | 110-43-0 |
| 2-methoxy-4-methylphenol | 0.005 | flavouring | 93-51-6 |
| 3-hexen-1-ol | 0.001 | flavouring | 928-96-1 |
| 4-ethylguaiacol | 0.005 | flavouring | 2785-89-9 |
| 6-methyl-5-hepten-2-one | 0.0005 | flavouring | 110-93-0 |
| acetic acid | 0.0005 | flavouring | 64-19-7 |
| acetoin | 0.01 | flavouring | 513-86-0 |
| acetophenone | 0.0001 | flavouring | 98-86-2 |
| alpha-irone | 0.0005 | flavouring | 79-69-6 |
| alpha-phellandrene | 0.0005 | flavouring | 99-83-2 |
| alpha-pinene | 0.005 | flavouring | 80-56-8 |
| alpha-terpineol | 0.0005 | flavouring | 98-55-5 |
| bergamot oil | 0.0005 | flavouring | 8007-75-8 |
| beta-caryophyllene | 0.005 | flavouring | 87-44-5 |
| beta-damascenone | 0.01 | flavouring | 23696-85-7 |
| beta-damascone | 0.005 | flavouring | 23726-91-2 |
| beta-ionone | 0.0001 | flavouring | 14901-07-6 |
| buchu leaves oil | 0.0005 | flavouring | 68650-46-4 |
| butyric acid | 0.001 | flavouring | 107-92-6 |

TABLE 1-continued

| | Maximal use level (% in the tobacco) | Function | CAS |
|---|---|---|---|
| camphene | 0.0001 | flavouring | 79-92-5 |
| carrot oil | 0.005 | flavouring | 8015-88-1 |
| cascarilla bark oil | 0.0005 | flavouring | 8007-06-5 |
| cedarwood oil | 0.001 | flavouring | 8000-27-9 |
| cellulose | 3.8 | binder | 9004-34-6 |
| chamomile flower, hungarian, oil | 0.0005 | flavouring | 8002-66-2 |
| chamomile flower, roman, extract & oil | 0.005 | flavouring | 8015-92-7 |
| cinnamon bark oil | 0.0005 | flavouring | 8015-91-6 |
| citral | 0.01 | flavouring | 5392-40-5 |
| citric acid | 0.0005 | flavouring | 77-92-9 |
| citronella oil | 0.0005 | flavouring | 8000-29-1 |
| cocoa and cocoa products | 0.005 | casing | various |
| coriander oil | 0.0005 | flavouring | 8008-52-4 |
| d,l-citronellol | 0.0005 | flavouring | 106-22-9 |
| davana oil | 0.005 | flavouring | 8016-03-3 |
| decanal | 0.0005 | flavouring | 112-31-2 |
| delta-decalactone | 0.001 | flavouring | 705-86-2 |
| d-limonene | 0.005 | flavouring | 5989-27-5 |
| ethyl acetate | 0.005 | flavouring | 141-78-6 |
| ethyl butyrate | 0.05 | flavouring | 105-54-4 |
| ethyl heptanoate | 0.0001 | flavouring | 106-30-9 |
| ethyl hexanoate | 0.005 | flavouring | 123-66-0 |
| ethyl lactate | 0.0005 | flavouring | 97-64-3 |
| ethyl laurate | 0.0005 | flavouring | 106-33-2 |
| ethyl maltol | 0.01 | flavouring | 4940-11-8 |
| ethyl nonanoate | 0.0005 | flavouring | 123-29-5 |
| ethyl oenanthate | 0.05 | flavouring | 8016-21-5 |
| ethyl palmitate | 0.005 | flavouring | 628-97-7 |
| ethyl propionate | 0.01 | flavouring | 105-37-3 |
| ethyl vanillin | 0.05 | flavouring | 121-32-4 |
| fenugreek extract | 0.001 | flavouring | 84625-40-1 |
| furaneol | 0.0005 | flavouring | 3658-77-3 |
| gamma-decalactone | 0.0005 | flavouring | 706-14-9 |
| gamma-nonalactone | 0.0005 | flavouring | 104-61-0 |
| gamma-valerolactone | 0.0005 | flavouring | 108-29-2 |
| geranyl acetate | 0.01 | flavouring | 105-87-3 |
| glycerol | 17 | humectant | 56-81-5 |
| guaiac wood oil | 0.005 | flavouring | 8016-23-7 |
| guaiacol | 0.05 | flavouring | 90-05-1 |
| guar gum | 2.2 | binder | 9000-30-0 |
| hexanal | 0.005 | flavouring | 66-25-1 |
| hexanoic acid | 0.005 | flavouring | 142-62-1 |
| hexyl acetate | 0.001 | flavouring | 142-92-7 |
| immortelle extract | 0.0001 | flavouring | 8023-95-8 |
| isoamyl butyrate | 0.005 | flavouring | 106-27-4 |
| isobutylcarbinol | 0.005 | flavouring | 123-51-3 |
| isobutyric acid | 0.0001 | flavouring | 79-31-2 |
| isopropylcarbinol | 0.0001 | flavouring | 78-83-1 |
| isopulegol | 0.001 | flavouring | 89-79-2 |
| isovaleric acid | 0.0005 | flavouring | 503-74-2 |
| jasmine absolute | 0.0001 | flavouring | 84776-64-7 |
| juniper oil | 0.001 | flavouring | 8002-68-4 |
| lauric acid | 0.0001 | flavouring | 143-07-7 |
| lemon oil | 0.01 | flavouring | 8008-56-8 |
| lime oil | 0.05 | flavouring | 8008-26-2 |
| litsea cubeba oil | 0.01 | flavouring | 68855-99-2 |
| lovage extract or oil | 0.0005 | flavouring | 8016-31-7 |
| mandarine oil | 0.005 | flavouring | 8008-31-9 |
| menthol | 1.4 | flavouring | 89-80-5 |
| menthyl acetate | 0.001 | flavouring | 16409-45-3 |
| methyl anthranilate | 0.0001 | flavouring | 134-20-3 |
| methyl cinnamate | 0.0001 | flavouring | 103-26-4 |
| methyl cyclopentenolone | 0.005 | flavouring | various |
| methyl phenylacetate | 0.0005 | flavouring | 101-41-7 |
| methyl salicylate | 0.005 | flavouring | 119-36-8 |
| nonanal | 0.0005 | flavouring | 124-19-6 |
| oakmoss absolute | 0.001 | flavouring | 9000-50-4 |
| octanoic acid | 0.0005 | flavouring | 124-07-2 |
| orange oil distilled | 0.05 | flavouring | 68606-94-0 |
| orange oil terpenes | 0.05 | flavouring | 68647-72-3 |
| orange oil, sweet | 0.05 | flavouring | 8008-57-9 |
| palmarosa oil | 0.0005 | flavouring | 8014-19-5 |
| pepper oil, black | 0.001 | flavouring | 8006-82-4 |

TABLE 1-continued

| | Maximal use level (% in the tobacco) | Function | CAS |
|---|---|---|---|
| peppermint oil | 0.5 | flavouring | 8006-90-4 |
| petitgrain oil | 0.001 | flavouring | 8014-17-3 |
| phenethyl acetate | 0.001 | flavouring | 103-45-7 |
| phenylacetaldehyde | 0.0001 | flavouring | 122-78-1 |
| phenylcarbinol | 0.2 | flavouring | 100-51-6 |
| pine needle oil | 0.001 | flavouring | 8021-29-2 |
| piperonal | 0.001 | flavouring | 120-57-0 |
| propenylguaethol | 0.0001 | flavouring | 94-86-0 |
| propylene glycol | 1 | humectant | 57-55-6 |
| sandalwood oil, yellow | 0.005 | flavouring | 8006-87-9 |
| spearmint oil | 0.05 | flavouring | 8008-79-5 |
| storax | 0.001 | flavouring | 8046-19-3 |
| styrylcarbinol | 0.005 | flavouring | 104-54-1 |
| sugar cane extract | 0.05 | flavouring | 90604-30-1 |
| tangerine oil terpeneless | 0.05 | flavouring | 68607-01-2 |
| tolu balsam gum | 0.001 | flavouring | 9000-64-0 |
| valeric acid | 0.0005 | flavouring | 109-52-4 |
| vanilla extract | 0.05 | flavouring | 2236902 |
| vanillin | 0.05 | flavouring | 121-33-5 |
| Water | 13 | moisturizer, processing aid | 7732-18-5 |

Although some of these flavorings may be considered safe when consumed at room temperature, the combination of aldehydes from the flavorants and propylene glycol (PG) leads to the formation of acetals that may have toxicological properties. In one study, various flavor aldehydes were mixed together with PG of varying concentration. (Bai, *Flavorants and Propylene Glycol from e-Cigarettes Form Harmful Irritants When Combined*, American Journal of Managed Care, Nov. 2, 2018) In every flavoring aldehyde tested, including vanillin, ethylvanillin, benzaldehyde, cinnamaldehyde, acetals were produced. Investigators also observed increasing acetal production when PG concentration was increased.

According to St. Helen G, Jacob III P, Nardone N, et al, "IQOS: examination of Philip Morris International's claim of reduced exposure", *Tobacco Control,* 27.Suppl 1 (2018): s30-s36, the aerosol generated by IQOS includes substantially higher levels of many emissions compared to a reference cigarette. As shown in Table 2 below, twenty-two constituents of unknown toxicity were at least 200% higher while seven were at least 1000% higher in IQOS emissions compared with a traditional 3R4F cigarette.

TABLE 2

| | Unit | IQOS HeatStick | 3R4F | Change (%) with 3R4F on stick basis |
|---|---|---|---|---|
| 1,2,3-Propanetriol, diacetate (diacetin) | μg/stick | 1.23 | 0.381 | ↑ 223 |
| 1,2-Propanediol, 3-chloro | μg/stick | 9.94 | 5.93 | ↑ 68 |
| 1,4-Dioxane, 2-ethyl-5-methyl- | μg/stick | 0.055 | 0.0004 | ↑ 13 650 |
| 12,14-Labdadiene-7,8-diol, (8a,12E) | μg/stick | 1.43 | 0.064 | ↑ 2134 |
| 1 hour-Indene, 2,3-dihydro-1,1,5,6-tetramethyl- | μg/stick | 0.026 | 0.014 | ↑ 86 |
| 1-Hydroxy-2-butanone | μg/stick | 0.947 | 0.465 | ↑ 104 |
| 1-Hydroxy-2-propanone(1,2-Propenediol) | μg/stick | 162 | 96.8 | ↑ 67 |
| 2 (5H)-Furanone | μg/stick | 5.32 | 1.99 | ↑ 167 |
| 2,3-Dihydro-5-hydroxy-6-methyl-4 hour-pyran-4-one | μg/stick | 0.231 | 0.135 | ↑ 71 |

TABLE 2-continued

| | Unit | IQOS HeatStick | 3R4F | Change (%) with 3R4F on stick basis |
|---|---|---|---|---|
| 2,4-Dimethylcyclopent-4-ene-1,3-dione | μg/stick | 0.333 | 0.193 | ↑ 73 |
| 2-Cyclopentene-1,4-dione | μg/stick | 3.8 | 0.764 | ↑ 397 |
| 2-Formyl-1-methylpyrrole | μg/stick | 0.128 | 0.064 | ↑ 100 |
| 2-Furancarboxaldehyde,5-methyl- | μg/stick | 11.1 | 2.94 | ↑ 278 |
| 2-Furanmethanol | μg/stick | 39.2 | 7 | ↑ 460 |
| 2-Furanmethanol, 5-methyl- | μg/stick | 0.123 | 0.029 | ↑ 324 |
| 2 hour-Pyran-2-one,tetrahydro-5-hydroxy | μg/stick | 4.45 | 3.11 | ↑ 43 |
| 2-Methylcyclobutane-1,3-dione | μg/stick | 2.78 | 0.71 | ↑ 292 |
| 2-Propanone, 1-(acetyloxy)- | μg/stick | 16.9 | 8.01 | ↑ 111 |
| 3 (2H)-Furanone, dihydro-2-methyl- | μg/stick | 0.326 | 0.119 | ↑ 174 |
| 3-Methylvaleric acid | μg/stick | 5.1 | 3.63 | ↑ 40 |
| 4(H)-Pyridine, N-acetyl- | μg/stick | 0.296 | 0.112 | ↑ 164 |
| 5-Methylfurfural | μg/stick | 0.995 | 0.632 | ↑ 57 |
| Anhydro linalool oxide | μg/stick | 0.457 | 0.291 | ↑ 57 |
| Benzene, 1,2,3,4-tetramethyl-4-(1-methylethenyl)- | μg/stick | 0.006 | 0.005 | ↑ 20 |
| Benzenemethanol, 4-hydroxy- | μg/stick | 0.011 | 0 | ↑ |
| Benzoic acid, 2,5-dihydroxy-methyl | μg/stick | 4.55 | 2.18 | ↑ 109 |
| Butylated hydroxytoluene | μg/stick | 0.132 | 0.007 | ↑ 1786 |
| Butyrolactone | μg/stick | 4.08 | 0.728 | ↑ 460 |
| Cis-sesquisabinene hydrate | μg/stick | 0.061 | 0 | ↑ |
| Cyclohexane, 1,2-dioxo- | μg/stick | 0.083 | 0.046 | ↑ 80 |
| Cyclohexane-1,2-dione, 3-methyl- | μg/stick | 0.101 | 0.073 | ↑ 38 |
| Eicosane, 2-methyl- | μg/stick | 0.05 | 0.014 | ↑ 257 |
| Ergosterol | μg/stick | 3.18 | 1.58 | ↑ 101 |
| Ethyl 2,4-dioxohexanoate | μg/stick | 6.73 | 3.57 | ↑ 89 |
| Ethyl dodecanoate (ethyl laurate) | μg/stick | 0.023 | 0 | ↑ |
| Ethyl linoleate | μg/stick | 0.135 | 0.008 | ↑ 1588 |
| Ethyl linolenate | μg/stick | 0.614 | 0.153 | ↑ 301 |
| Furfural | μg/stick | 31.1 | 25.9 | ↑ 20 |
| Glycerol | μg/stick | 5.02 | 2.08 | ↑ 141 |
| Glycidol | μg/stick | 5.71 | 1.76 | ↑ 224 |
| Heneicosane, 2-methyl- | μg/stick | 0.063 | 0.021 | ↑ 200 |
| Hexadecanoic acid, ethyl ester | μg/stick | 0.491 | 0.008 | ↑ 6038 |
| Isolinderanolide | μg/stick | 4.99 | 1.85 | ↑ 170 |
| Isoquinoline, 3-methyl | μg/stick | 6.29 | 4.99 | ↑ 26 |
| Labdane-8,15-diol, (13S) | μg/stick | 0.143 | 0.015 | ↑ 853 |
| Lanost-8-en-3-ol, 24-methylene-,(3beta) | μg/stick | 6.3 | 1.61 | ↑ 291 |
| Maltoxazine | μg/stick | 0.077 | 0.038 | ↑ 103 |
| Methyl furoate | μg/stick | 0.147 | 0.029 | ↑ 407 |
| Phenylacetaldehyde | μg/stick | 1.41 | 0.529 | ↑ 167 |
| p-Menthan-3-ol | μg/stick | 0.786 | 0.322 | ↑ 144 |
| Propylene glycol | μg/stick | 175 | 23.7 | ↑ 638 |
| Pyranone | μg/stick | 6.54 | 5.07 | ↑ 29 |
| Pyranone | μg/stick | 9.26 | 5.84 | ↑ 59 |
| Pyridoxin | μg/stick | 0.699 | 0.526 | ↑ 33 |
| Stearate, ethyl- | μg/stick | 0.074 | 0.003 | ↑ 2367 |
| Tar | mg/stick | 19.4 | 25 | ↓ 22 |
| Trans-4-hydroxymethyl-2-methyl-1,3- dioxolane | μg/stick | 2.09 | 0.044 | ↑ 4650 |
| 1,3-Butadiene | μg/stick | 0.21 | 89.2 | ↓ 99.8 |
| 1-Aminonaphthalene | ng/stick | 0.043 | 20.9 | ↓ 99.8 |
| 2-Aminonaphthalene | ng/stick | 0.022 | 17.5 | ↓ 99.9 |
| 3-Aminobiphenyl | ng/stick | 0.007 | 4.6 | ↓ 99.8 |
| 4-Aminobiphenyl | ng/stick | 0.009 | 3.21 | ↓ 99.7 |
| Acetaldehyde | μg/stick | 192 | 1602 | ↓ 88 |
| Acetamide | μg/stick | 2.96 | 13 | ↓ 77 |
| Acetone | μg/stick | 30.7 | 653 | ↓ 95 |
| Acrolein | μg/stick | 8.32 | 158 | ↓ 95 |
| Acrylamide | μg/stick | 1.58 | 4.5 | ↓ 65 |
| Acrylonitrile | μg/stick | 0.145 | 21.2 | ↓ 99.3 |
| Ammonia | μg/stick | 12.2 | 33.2 | ↓ 63 |

TABLE 2-continued

| | Unit | IQOS HeatStick | 3R4F | Change (%) with 3R4F on stick basis |
|---|---|---|---|---|
| Arsenic | ng/stick | <0.36 | <7.49 | NA |
| Benz[a]anthracene | μg/stick | 2.65 | 28.4 | ↓ 91 |
| Benzene | μg/stick | 0.45 | 77.3 | ↓ 99.4 |
| Benzo[a]pyrene | ng/stick | 0.736 | 13.3 | ↓ 94 |
| Butyraldehyde | μg/stick | 20.7 | 81.3 | ↓ 74 |
| Cadmium | ng/stick | <0.28 | 89.2 | ↓ >99.7 |
| Carbon monoxide | mg/stick | 0.35 | 29.4 | ↓ 99 |
| Catechol | μg/stick | 14 | 84.1 | ↓ 83 |
| Chromium | ng/stick | <11.0 | <11.9 | NA |
| Crotonaldehyde | μg/stick | <3.29 | 49.3 | ↓ >93 |
| Dibenz[a,h] anthracene | ng/stick | <0.124 | <0.689 | NA |
| Ethylene oxide | μg/stick | <0.119 | 16 | ↓ >99.3 |
| Formaldehyde | μg/stick | 14.1 | 79.4 | ↓ 82 |
| Hydrogen cyanide | μg/stick | <1.75 | 329 | ↓ >99.5 |
| Hydroquinone | μg/stick | 6.55 | 94.5 | ↓ 93 |
| Isoprene | μg/stick | 1.51 | 891 | ↓ 99.8 |
| Lead | ng/stick | 2.23 | 31.2 | ↓ 93 |
| m-Cresol | μg/stick | 0.042 | 4.24 | ↓ 99 |
| Mercury | ng/stick | 1.38 | 3.68 | ↓ 63 |
| Methyl-ethyl-ketone | μg/stick | 10.1 | 183 | ↓ 94 |
| Nickel | ng/stick | <15.9 | <12.9 | NA |
| Nicotine | mg/stick | 1.29 | 1.74 | ↓ 26 |
| Nitric oxide | μg/stick | 12.6 | 484 | ↓ 97 |
| Nitro benzene | μg/stick | <0.011 | <0.038 | NA |
| Nitrogen oxides | μg/stick | 14.2 | 538 | ↓ 97 |
| N-nitrosoanabasine | ng/stick | 2.35 | 29 | ↓ 92 |
| N-nitrosoanatabine | ng/stick | 14.7 | 254 | ↓ 94 |
| NNK | ng/stick | 7.8 | 244.7 | ↓ 97 |
| NNN | ng/stick | 10.1 | 271 | ↓ 96 |
| o-Cresol | μg/stick | 0.078 | 4.81 | ↓ 98 |
| o-Toluidine | ng/stick | 1.1 | 96.2 | ↓ 99 |
| p-Cresol | μg/stick | 0.071 | 9.6 | ↓ 99 |
| Phenol | μg/stick | 1.47 | 15.6 | ↓ 91 |
| Propionaldehyde | μg/stick | 10.8 | 109 | ↓ 90 |
| Propylene oxide | ng/stick | 142.3 | 896 | ↓ 84 |
| Pyrene | ng/stick | 8.2 | 79.2 | ↓ 90 |
| Pyridine | μg/stick | 6.58 | 30.9 | ↓ 79 |
| Quinoline | μg/stick | <0.011 | 0.43 | ↓ >98 |
| Resorcinol | μg/stick | <0.055 | 1.72 | ↓ >97 |
| Selenium | ng/stick | 1.27 | <4.42 | NA |
| Styrene | μg/stick | 0.58 | 13.9 | ↓ 96 |
| Toluene | μg/stick | 1.42 | 129 | ↓ 99 |
| Vinyl chloride | ng/stick | <0.657 | 93.4 | ↓ >99 |
| Water | mg/stick | 30.2 | 14.7 | ↑ 105 |

While not wanting to be bound to any particular theory, applicant currently believes that heating and aerosolization of the substantial number of flavorants and synthetic additives, especially in the presence of PG, generates many of these emissions of unknown toxicity in long term use by adults. The acetals, in particular, are potentially produced by the heating of flavorants in the presence of PG.

Another heat-not-burn product is GLO sold by British American Tobacco and described in U.S. Published Patent Application No. 2018/0049469A1. As illustrated in FIG. 3, the GLO apparatus 1 has a heating chamber 4 which, in use, contains the smokable material to be heated and volatized. The smokable material is a cylinder 5 formed of dry tobacco product that, like the tobacco product of IQOS, has been soaked in propylene glycol and then dried. An end of the smokable material article 5 projects out of the apparatus 1 through the open end 3 of the housing 2. The article 5 typically includes, like the IQOS Heatstick, a filter element at its outermost end. The heating chamber 4 includes heating elements 10 made of a ceramic material.

In use, the heating elements 10 aerosolize the dry tobacco product within cylinder 5 in a manner similar to that described above in connection with IQOS. The user inhales the aerosol through the proximal end of cylinder 5. The operation of the GLO product is similar to IQOS in that a heater aerosolizes the dry tobacco product and the user inhales the aerosol.

While the ingredients added to the tobacco product in GLO are not known, it is believed that the number, kind and type of additives are similar to those used in IQOS. Accordingly, it is believed that GLO generates an aerosol including many of the same constituents as IQOS.

Another popular heat-not-burn product is Ploom sold by Japan Tobacco Industries and described in U.S. Published Patent Application 2015/0208729. As shown in FIG. 4, the Ploom heater 305 aerosolizes a humectant-containing tobacco product 306 as air is drawn through inlet 321. The vapor emitted from the tobacco product condenses in the condensation chamber 303. The gas phase humectant vapors begin to cool and condense into droplets. In this manner an aerosol is formed and inhaled by the user. In some Ploom variants the heat is provided by butane gas, the combustion products from which are also inhaled by the user. The Ploom product also suffers from the same disadvantages described above with respect to IQOS and GLO.

In the more recently released Ploom Tech/Tech+ product, liquid in a reservoir is vaporized by a heater and that vapor is passed through a dry tobacco product that has been treated with a mixture of propylene glycol and glycerin (30:70 by weight). The vapor cools and condenses into droplets which pick up nicotine and tobacco flavor from the dry tobacco product. According to the above-referenced patent application, the propylene glycol produced a "far denser, thicker aerosol comprising more particles than would have otherwise been produced" with natural glycerin.

While the Ploom Tech/Tech+ product operates at a lower temperature than other heat-not-burn products describe above, and thus produces fewer HPHCs, the vapor produced by this product has limited ability to extract taste and nicotine from the dry tobacco product through which the vapor passes. The resulting user experience is correspondingly diminished.

Each of these conventional heat-not-burn products produces a taste and user experience which consumers have generally found lacking. The taste provided by the aerosols of conventional heat-not-burn products is not as rich and satisfying as traditional tobacco products and, as a consequence, conventional heat-not-burn products have not accomplished the stated goal of reducing smoking of traditional cigarettes. Because of the inferior taste and user experience, user adoption of heat-not-burn products has been slow in many countries and traditional cigarette usage has not been substantially abated.

The conventional heat-not-burn products thus suffer from one or more of the following disadvantages. First, numerous synthetic and potentially toxic ingredients are added in an effort to achieve acceptable taste. Second, the resulting taste and user experience have fallen far short of that required to encourage widespread migration from traditional cigarette smoking. Third, the conventional products include propylene glycol, the aerosolization of which may generate harmful effluents especially when heated in the presence of common flavorants. Fourth, the tobacco products used in the conventional products are not organic. The use of non-organic tobacco products further limits the potential health benefits provided by these heat-not-burn products as they may contain various agricultural fertilizers, pesticides and herbicides. Fifth, the conventional tobacco products generate various carcinogens not naturally present in tobacco. These additional carcinogens are cross-purposes with the stated objective of heat-not-burn devices, to provide a safer and healthier alternative to smoking traditional cigarettes.

Additionally, the conventional heat-not-burn delivery devices are relatively expensive to manufacture. Many include inhalation sensing or "puff detection" systems that automatically control heating. Some include gas-powered heating mechanisms or portable charging and/or heating units that are large, expensive, and relatively bulky. Still others include inductive heating systems which are both complex and expensive. Certain products use both fluid reservoirs and separate supplies of dry or partially moistened reconstituted tobacco material. The result, heretofore, has been a series of heat-not-burn devices that are relatively expensive and complex to manufacture, both with respect to the base unit, charger and/or heater and with respect to the consumable liquid and/or tobacco product.

Certain embodiments described herein address one or more of the foregoing problems. Certain embodiments which are exemplified herein solve most or all of these problems. However, the scope of the invention is defined by the claims and the foregoing discussion of the shortcomings of the conventional heat-not-burn products should not be construed to limit the claims by implication or otherwise. Various embodiments described herein and within the scope of the claims may not solve certain, or any, of the particular problems addressed above. Again, however, the embodiments that are currently most preferred solve many, most or all of these problems.

SUMMARY OF ILLUSTRATIVE EMBODIMENTS

The conventional heat-not-burn devices discussed above use dry tobacco product in order to promote heating and aerosolization of the tobacco product. Aerosolization of the tobacco product requires air, and thus each of the conventional heat-not-burn products include dry tobacco product through which air can flow, as in a traditional cigarette. Even in conventional vaping devices, wicks are used to draw nicotine-containing liquid into an air stream, which ensures that the aerosolization process is not starved of air.

The applicant has discovered that, surprisingly, by careful design of the tobacco product and delivery device it is possible to aerosolize wet tobacco product even when the heating element is substantially surrounded by the wet tobacco product. Such an aerosolization process keeps temperatures very low (on the order of 100° C.) which reduces HPHCs as much as 4, 5 or 6 times or more relative to conventional heat-not-burn products. In contrast to conventional vaping products, however, the aerosolized product is real leaf tobacco and contains no added nicotine or flavorants. That, in turn, avoids the increased risk of addiction and short-term health effects reported in connection with modern vaping devices.

Also, unlike conventional heat-not-burn or vaping products, embodiments exemplified herein provide an improved taste and user experience that is more likely to replace smoking of traditional cigarettes, thereby providing a substantial health benefit to the public. Conventional vaping devices are not typically considered to be smoking substitutes, as users often continue smoking cigarettes while vaping and often become addicted to vaping in the process. The result is that users sometimes become dual product users instead of single product users. The absence of the fulsome taste and experience of natural tobacco is believed to contribute to these disadvantages. Preferred embodiments of the instant invention overcome those disadvantages by providing an improved taste and adult user experience that is likely to replace traditional cigarettes without the added nicotine, associated addiction risk, and short-term health effects of vaping and without the elevated HPHC levels associated with conventional heat-not-burn devices and flavorants.

In a smoke test involving twenty-one participants who sampled the IQOS Heatstick (currently the most popular heat-not-burn product for sale internationally) and an embodiment of the invention exemplified herein, the product of the invention was deemed to provide far improved taste and ease of use. As to taste, on a scale of 1 to 5 (5 being best) IQOS received a rating of 1.29 (1 being worst) and the product of Example 4 was given a rating of 4.57 (5 being best). For ease of use, IQOS received a rating of 1.05 compared to 4.95 for the preferred embodiment of the invention exemplified herein. None of the twenty-one smoke test participants was aware of any affiliation between the administrator of the study and either of the products.

The applicant also discovered that, in order to achieve aerosolization of wet tobacco product, it is advantageous to carefully control the viscosity of the composition of the material and the manner in which it contacts the heating element. While conventional heat-not-burn and vaping products use dry tobacco product or wicks to ensure that ample air flow is supplied to the heated tobacco product or nicotine-containing liquid, immersing the heating element in a wet tobacco product was not previously considered feasible because the wet tobacco product was expected to smother the heating element and impede or eliminate effective aerosolization. Indeed, the applicant has found that in many potential embodiments the heating element is in fact fully smothered and consequently underperforms and draws power rapidly from the battery, further impeding performance.

As shown in Comparative Example 1, if the tobacco product is too wet or too much of it surrounds the heating element, one or more of the following problems are encountered. First, as noted above the heating element may be smothered, preventing effective aerosolization. Second, only a small portion of the total available tobacco product may be consumed relative to the total amount contained in the pod or reservoir. Third, the aerosolization may occur for an insufficient number of puffs, such as 1-30 puffs where 200 or more puffs on the exemplified embodiments are required to substantially exhaust the supply of tobacco product in the pod or reservoir. Fourth, the heating element may need to be raised to an elevated temperature, such as approaching or exceeding 300 degrees Celsius, in order for aerosolization to occur. At such temperatures elevated levels of HPHCs are typically produced.

Applicant found that at certain wet tobacco viscosities it is possible to enclose the tobacco product with a deformable or collapsible pod that substantially enhances the aerosolization of the tobacco product. For instance, a pod made of silicone with a wall thickness on the order of about 1 mm may be used. While not wishing to be bound to a particular theory, it is believed that during inhalation the pod wall partially collapses or changes shape and deforms due to negative pressure applied by inhalation, thereby drawing the wet tobacco product into intimate contact with the heating element. After inhalation suction is removed, the pod expands to its original shape, which advantageously draws air into the interstices of the wet but relatively high viscosity tobacco product. The physical properties of the pod—made of silicone with a wall thickness on the order of about 1 mm—confer a balance of being flexible enough to be deformed by the negative pressure of inhalation but also rigid enough to return to its original shape and advantageously draw air into the tobacco product between puffs. During the next puff, as the element is heated, the tobacco product is once again brought into intimate contact with the heating element. In this fashion the pod wall performs a bellows-like function, aerating and agitating the tobacco product thus enhancing aerosolization during the next puff or inhalation.

This is a fundamental departure from conventional heat-not-burn and vaping products, all of which use either a static dry tobacco pile, or static moistened wrapped core of reconstituted tobacco product through which air naturally flows or a wicking system to bring nicotine containing liquid into a high flow rate air stream where it is heated and aerosolized.

The systems and methods described herein benefit from a careful balancing of the composition and the design of the delivery device. By proper selection of the composition and delivery device, in preferred embodiments a pod containing just 1.3 g of tobacco product provides 150 puffs, compared to 12-14 puffs provided by a typical cigarette or an IQOS Heatstick.

As noted above, embodiments of the invention exemplified herein would reduce HPHCs relative to IQOS by a factor of four, five or six even if the former used a tobacco product containing the same array of synthetic ingredients added to the IQOS Heatstick. However, the exemplified embodiments use a simple, organic recipe comprising (or alternatively, consisting essentially of) three ingredients: about 65-75% natural or organic glycerin, about 5-15% of distilled, tap or purified water, and about 20% organic whole leaf tobacco or leaf/lamina tobacco. The exemplified embodiments thus are likely to produce less than one sixth of the HPHCs of IQOS, for instance one seventh, eighth, ninth or tenth the HPHCs of IQOS. Moreover, unlike IQOS and other conventional heat-not-burn products, the exemplified products do not generate select carcinogens not naturally present in tobacco.

The exemplified consumable units are also substantially less complicated and expensive to manufacture. In particular, manufacturing an IQOS Heatstick involves a complex process for production of sheet tobacco that is post-processed and rolled into rods that include filters and other elements. Like the manufacture of a traditional cigarette, production of the Heatstick is a multi-step process that involves an expensive and relatively large manufacturing facility. By contrast, the process of preparing the composition of the exemplified embodiments merely involves the high-pressure heating of tobacco product followed by drying, grinding and combining the ground tobacco product about 1:1 by weight with glycerin, after which the tobacco product is added to the pod.

In another aspect, the heat-not-burn system disclosed herein is the first to achieve acceptable aerosolization without propylene glycol or an auxiliary moisture water or vapor source. As discussed above, conventional heat-not-burn products use real tobacco or reconstituted tobacco but rely upon propylene glycol or an additional source of water vapor to provide an enhanced user taste and experience. The exemplified embodiments described herein use neither, which avoids the adverse effects of propylene glycol such as the formation of acetals in the presence of common flavorants and the complexity and expense of providing an auxiliary source of water vapor.

Another advantage of the embodiments exemplified herein is that the tobacco product contained in the disposable pod or cup unit need not be consumed in a single smoking session. Conventional heat-not-burn tobacco products such as IQOS and GLO provide mini-cigarettes or pods that must be used in one sitting or smoking session, as the dry tobacco product is carbonized after heating and not thereafter suitable for reheating in another smoking session. Rather, the mini-cigarette or pod must be replaced. In contrast, the embodiments exemplified herein provide around ten times more puffs per pod (about 150-250 versus about 10-15) and need not be consumed all in one smoking session. While not wishing to be bound to a particular theory, applicant believes that this is due to the unique wet tobacco product composition and the unique mechanism of action which prevent carbonization of the wet tobacco product. A user of one of the exemplified embodiments thus may use a single pod over around ten smoking sessions spaced over many hours or even days.

Accordingly, in an embodiment, a heat-not-burn tobacco aerosolization device is provided, having a disposable mouthpiece unit having a cup having walls that can be configured to deform inwardly under negative inhalation pressure applied by a user, the cup containing a wet tobacco product having at least about 65% glycerin by weight, at least about 5% water by weight, and at least about 15% tobacco by weight, the cup further at least partially containing a heating element that is substantially surrounded by and in contact with the wet tobacco product, and a base unit including a controller configured to supply a current to the heating element. The device can be configured to, during a heating cycle lasting about one to five seconds (or values therebetween), aerosolize the wet tobacco product at a temperature not exceeding about 150° C. as measured in the wet tobacco product 1 mm from the heating element and aerosolize a liquid portion of the wet tobacco product by boiling the liquid portion in contact with the heating element.

The device can be configured, for example, to aerosolize the wet tobacco product to generate an aerosolized inhalant that can be inhaled by a user through the mouthpiece unit. The aerosolized inhalant can have, for example, at least four times less, or at least six time less, HPHCs than the inhaled smoke of a 3R4F traditional cigarette. The device can be configured to, for example, during a heating cycle lasting about one to five seconds (or values therebetween), aerosolize the wet tobacco product at a temperature not exceeding about 100° C., 120° C., or 140° C. as measured in the wet tobacco 1 mm from the heating element. The wet tobacco product in the device can have a viscosity, for example, of about 10,000 to 50,000 cp, or from about 20,000 to 40,000 cp. The wet tobacco product can consist of, or consist essentially of, for example, tobacco, glycerin and water. In an aspect, the wet tobacco product does not contain propylene glycol.

The mouthpiece unit can, for example, enclose the cup and can include a surface that substantially seals an open end of the cup and includes an aperture which leaves the wet tobacco product partially exposed. In an aspect, the wet tobacco product does not comprise additional nicotine not present in the tobacco leaves used to make the wet tobacco product. The wet tobacco product can, for example, have processed tobacco leaves, and the aerosolized inhalant can include no carcinogen that is not naturally present in an aerosol produced by aerosolizing only the processed tobacco leaves at the same temperature.

In another aspect, a heat-not-burn tobacco aerosolization device is provided, having a disposable mouthpiece unit having a cup which contains a wet tobacco product having a viscosity of about 10,000 to 50,000 cp and having at least about 65% glycerin by weight, at least about 5% water by weight, and at least about 15% tobacco by weight. The cup can at least partially contain a heating element which is substantially surrounded by and in contact with the wet tobacco product and a base unit configured to supply a current to the heating element. The device can, during a heating cycle lasting one to five seconds (or values therebetween), aerosolize the wet tobacco product at a temperature not exceeding about 150° C. as measured in the wet tobacco product 1 mm from the heating element, where the device can aerosolize the wet tobacco product to generate an aerosolized inhalant for inhalation by a user through the mouthpiece, where the aerosolized inhalant has at least four times less HPHCs than the inhaled smoke of a 3R4F traditional cigarette.

In an aspect, the cup can have walls that deform inwardly under negative inhalation pressure applied by a user. The device can be configured to aerosolize a liquid portion of the wet tobacco product by boiling the liquid portion in contact with the heating element. The aerosolized inhalant can have, for example, at least six times less HPHCs than the inhaled smoke of a 3R4F traditional cigarette. The device can be configured to, during a heating cycle lasting less than five seconds, aerosolize the wet tobacco product at a temperature less than about 100° C., 120° C., or 140° C. as measured in the wet tobacco 1 mm from the heating element. The wet tobacco product in the device can have, for example, a viscosity of about 20,000 to 40,000 cp. The wet tobacco product in the device can consist of or consist essentially of, for example, tobacco, glycerin and water. In another aspect, the wet tobacco product does not contain propylene glycol. The mouthpiece unit can enclose the cup and can include a surface which substantially seals an open end of the cup and includes an aperture which leaves the wet tobacco product partially exposed. In an aspect, the wet tobacco product in the device does not comprise additional nicotine other than that which is present in the tobacco leaves used to make the wet tobacco product.

In yet another aspect, the wet tobacco product inserted into the aerosolization and inhalation device can contain processed tobacco leaves and the aerosolized inhalant includes no carcinogen that is not naturally present in an aerosol produced by aerosolizing only processed tobacco leaves at the same temperature.

In a further aspect, the tobacco product may be wet and may be prepared by first separating a dry leaf tobacco into grinds or strips or pieces having a largest dimension of 50 to 2,000 microns, or more preferably 100 to 1,000 microns. In certain embodiments, the size of the tobacco product particles, pieces, strips, or grounds has an average largest dimension or diameter of about 50-100, 100-200, 200-300, 300-400, 400-500, 500-600, 600-700, 700-800, 800-900, 900-1,000, 1,000-1,100, 1,100-1,200, 1,200-1,300, 1,300-1,400, 1,400-1,500, 1,500-1,600, 1,600-1,700, 1,700-1,800, 1,800-1,900, or 1,900-2,000 microns.

In another aspect, the cut/ground tobacco may be mixed with a solvent or "suspension agent" such as glyercin or, less preferably, propylene glycol (PG), polyethylene glycol, polysorbate 80 and mixtures thereof. The ratio of tobacco to suspension agent (w/w) can be from about 3:1, 2:1, 1.5:1, 1.2:1, 1:1, 1:1:1.2, 1:1.5, 1:2 or 1:3 or values therebetween.

In an aspect, after the tobacco has been combined with the suspension agent, water is optionally added to the mixture. For example, in an embodiment, from about 1%, 5%, 7%, 10%, 15%, 20%, 25%, 30%, 40%, 50% or 60% water (w/w) can be added to the mixture.

In yet another aspect, the resulting wet tobacco product that is inserted into the heat-not-burn device is organic and is a mixture of three components: water, glycerin, and tobacco. The tobacco product can include about 20-25, 25-30, 30-35, 35-40, 40-55, 50-55, 55-60, 60-65, 60-65, 65-70, 70-75, or 75-80% glycerin by weight. The tobacco product can include about 1-5, 5-10, 10-15, 15-20, 20-25, 25-30, 30-35, 35-40, or 40-50% water by weight or values therebetween. The tobacco product can include about 1-5, 10, 11, 12, 13, 14, 15, 16, 17, 18, 19, 20, 21, 22, 23, 24, 25-30, 30-35, 35-40, or 40-50% tobacco by weight or values therebetween. In a currently preferred embodiment, the product consists of about 65-75% glycerin, 5-15% water, and 20% tobacco by weight or values therebetween.

In another aspect, the tobacco product composition is of a flowable, relatively thick jam-like consistency. The viscosity of the tobacco product may be between about 5,000 and 80,000 cp. In various embodiments, the viscosity is about 5,000-10,000, 10,000-20,000, 20,000 to 30,000, 30,000 to 40,000, 40,000-50,000, 50,000 to 60,000, 60,000 to 70,000, or 70,000 to 80,000 cp. In the embodiment which is currently most preferred, the viscosity is between about 20,000 and 50,000 cp.

The forgoing general description of the illustrative implementations and the following detailed description thereof are merely exemplary aspects of the teachings of this disclosure and are not restrictive. As noted above, certain embodiments within the scope of this disclosure and the claims may not provide the particular advantages set forth above. That said, the most preferred embodiments provide many, most or all of the foregoing advantages relative to conventional heat-not-burn and vaping devices.

BRIEF DESCRIPTION OF THE DRAWINGS

The accompanying drawings, which are incorporated in and constitute a part of the specification, illustrate one or more embodiments and, together with the description, explain these embodiments. The accompanying drawings have not necessarily been drawn to scale. Any values or dimensions illustrated in the accompanying graphs and figures are for illustration purposes only and may or may not represent actual or preferred values or dimensions. Where applicable, some or all features may not be illustrated to assist in the description of underlying features. In the drawings.

DETAILED DESCRIPTION OF ILLUSTRATIVE EMBODIMENTS

Figure 1A:
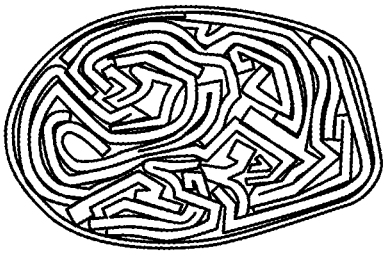
FIG. 1A PRIOR ART
FIG. 1A and FIG. 1B are pictures of a conventional tobacco product used in an electronic nicotine delivery system (ENDS) heat-not-burn device.
Figure 1B:
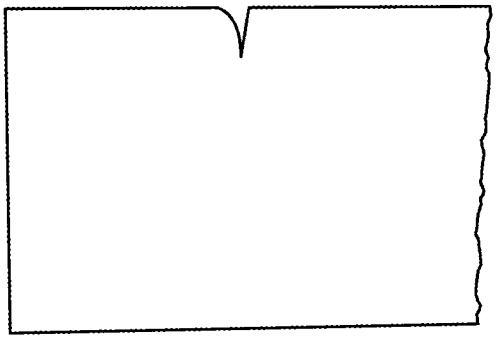
FIG. 1B PRIOR ART
Figure 2:
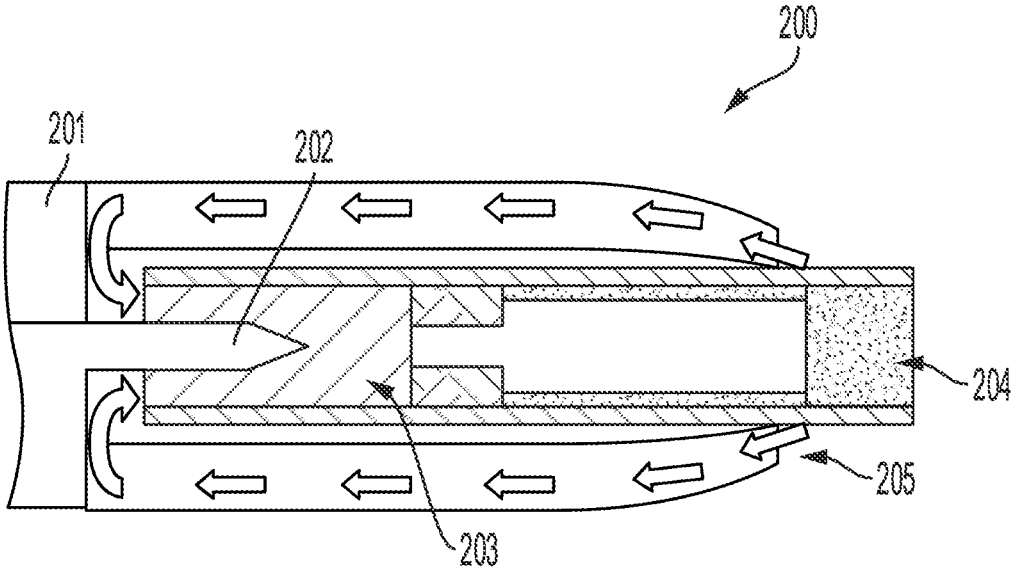
FIG. 2 PRIOR ART
FIG. 2 is an illustration of the conventional IQOS Heatstick heat-not-burn device.
Figure 3:
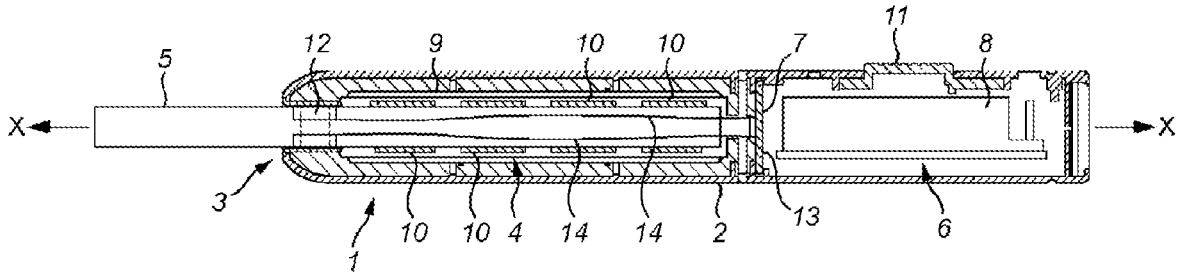
FIG. 3 PRIOR ART
FIG. 3 is an illustration of the conventional GLO heat-not-burn device.

The description set forth below in connection with the appended drawings is intended to be a description of various illustrative embodiments of the disclosed subject matter. Specific features and functionalities are described in connection with each illustrative embodiment; however, it will be apparent to those skilled in the art that the disclosed embodiments may be practiced without each of those specific features and functionalities.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments. Further, it is intended that embodiments of the disclosed subject matter cover modifications and variations thereof.

All patents, applications, published applications and other publications referred to herein are incorporated by reference for the referenced material and in their entireties.

It must be noted that, as used in the specification and the appended claims, the singular forms "a," "an," and "the" include plural referents unless the context expressly dictates otherwise. That is, unless expressly specified otherwise, as used herein the words "a," "an," "the," and the like carry the meaning of "one or more." Additionally, it is to be understood that terms such as "left," "right," "top," "bottom," "front," "rear," "side," "height," "length," "width," "upper," "lower," "interior," "exterior," "inner," "outer," and the like that may be used herein merely describe points of reference and do not necessarily limit embodiments of the present disclosure to any particular orientation or configuration. Furthermore, terms such as "first," "second," "third," etc., merely identify one of a number of portions, components, steps, operations, functions, and/or points of reference as disclosed herein, and likewise do not necessarily limit embodiments of the present disclosure to any particular configuration or orientation.

Furthermore, the terms "approximately," "about," "proximate," "minor variation," and similar terms generally refer to ranges that include the identified value within a margin of 20%, 10% or preferably 5% in certain embodiments, and any values therebetween.

The term "tobacco curing" refers to the partial drying of tobacco leaves once they are picked. The cellular contents, such as carotenoids, chlorophyll, and other components of the leaf partially degrade to become a more palatable form than would be present in fresh tobacco. The process can occur, for example, by air curing, flue curing, sun curing, fire curing and fermentation curing (such as perique). The process takes from a few days to several weeks, and months in the case of fermentation curing, depending on the method used.

The term "organic" or "organically grown" refers to tobacco leaves that are grown under organic standards, such as by allowing the use of naturally occurring substances to enhance growth or decrease pests, while prohibiting or strictly limiting synthetic substances that are placed on the plant or the soil in which it is grown.

The term "pesticide free" refers to tobacco leaves that have not been treated with a pesticide during their growing season.

The term "glycerin" (also termed glycerol or propane-1,2,3-triol) is a three-carbon compound with three alcohol groups. It is a sweet-tasting, viscous, non-toxic and substantially colorless liquid.

The term "propylene glycol" (also termed propane-1,2-diol) refers to a three-carbon compound with two alcohol groups. It is a viscous and substantially colorless liquid.

All of the functionalities described in connection with one embodiment are intended to be applicable to the additional embodiments described below except where expressly stated or where the feature or function is incompatible with the additional embodiments. For example, where a given feature or function is expressly described in connection with one embodiment but not expressly mentioned in connection with an alternative embodiment, it should be understood that the inventor intends that that feature or function may be deployed, utilized or implemented in connection with the alternative embodiment unless the feature or function is incompatible with the alternative embodiment.

Figure 6:
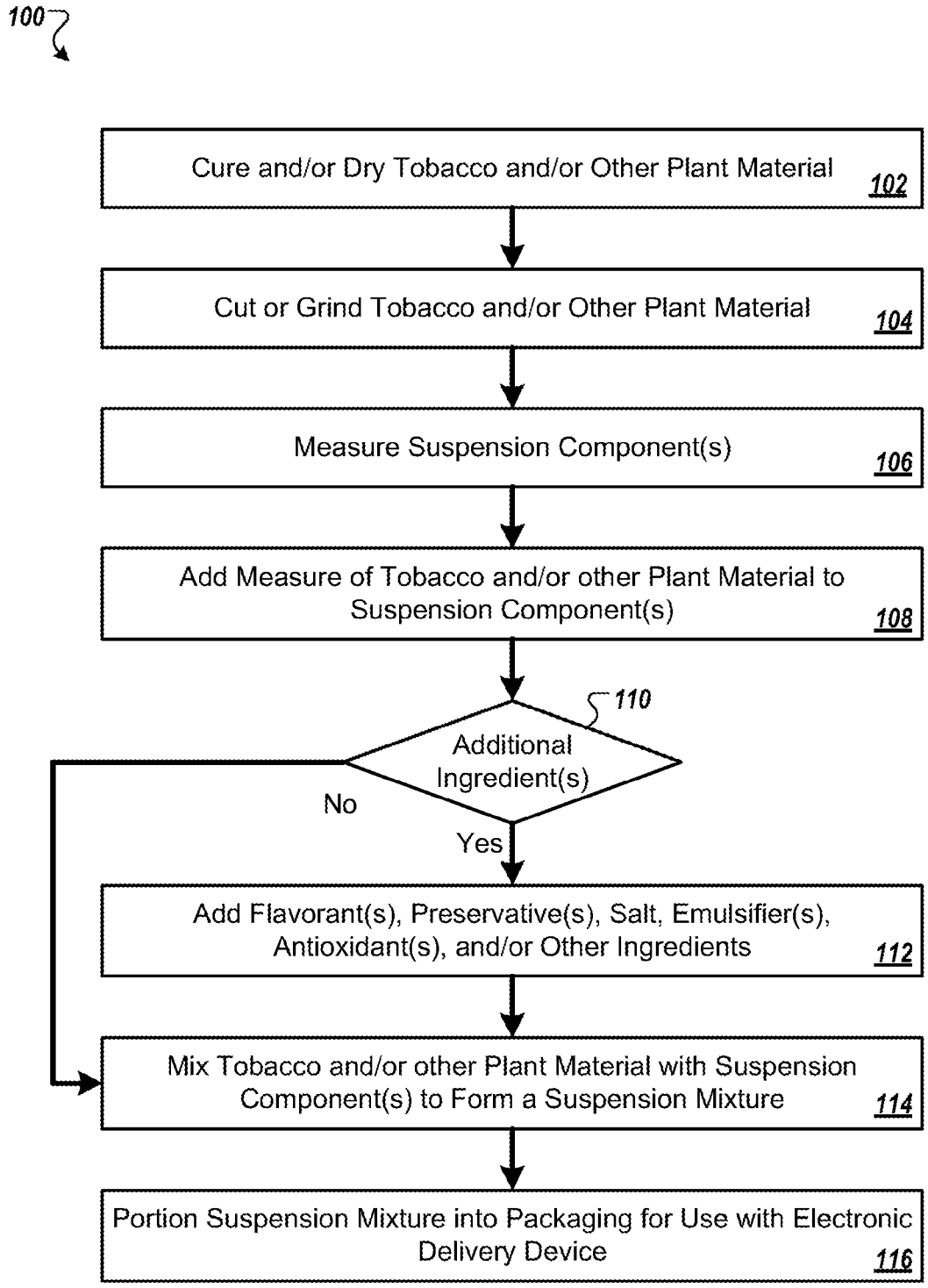
FIG. 6 a flow diagram illustrating an example method for preparing a tobacco and/or other plant material suspension.

An illustrative process 100 for preparing the exemplified tobacco product is shown in FIG. 6. Turning to FIG. 6, in some embodiments, the process 100 begins with curing and/or drying tobacco and/or another plant material (102). If two or more plant materials are used, such as both a tobacco and an herb, each plant material may be cured or dried separately to reach a desired state.

In some embodiments, the whole leaf tobacco material, or only the lamina section of the tobacco leaf, is cut or ground (104). Example processes for cutting, grinding, or mincing tobacco and/or other plant materials are provided below. If two or more plant materials are used, such as both a whole leaf or lamina only tobacco and a whole leaf or lamina only herb, each plant material may be cut or ground separately to reach a desired size and/or shape.

In some embodiments, the suspension component is measured (106). Measurements can be implemented, for example, on a weight to weight basis. In one example the suspension component is glycerin and is measured as 1 g glycerin to 1 g tobacco. In order to be suitable for both small-scale and large-scale preparations, these amounts are generally shown herein as a ratio of the weight of the tobacco to the weight of the suspension component. Examples of suspension components that can be used are presented below. In various embodiments, the ratio of the tobacco and/or other plant material to the suspension component(s) can be 1:10, 1:5, 1:2, 2:3, 3:2, 2:1, 5:1, or 10:1 by weight or values therebetween.

The suspension component, in some implementations, is added (108) to the cut/ground tobacco/and or other plant material. In some embodiments, the preparation contains only the suspension component and the tobacco/and or other plant material, without the presence of other added ingredients. In some embodiments, this may be preferred by the user as a more "pure" or "natural" preparation. In preferred implementations, the tobacco and/or herb and the resulting tobacco product mixture is organic.

Alternatively, in some embodiments, additional ingredients are included (110). Care should be taken when using PG as a suspension component in combination with added flavorants. As discussed above, heating of these two components in the presence of one another is known to produce acetals.

In some embodiments, the tobacco and/or other plant material is then mixed to form a suspension mixture (114). The mixing step can occur at various mixing speeds, at various temperatures, and in various types of processing apparatus. The mixing can occur intermittently, and the ingredients can be added all at once, or step by step. In some implementations, some ingredients are pre-mixed together and then mixed into the suspension mixture.

In one embodiment that may be used to prepare the tobacco product exemplified herein, the tobacco product is the tobacco and/or herb product is heated at a pressure of 5-20 atmospheres in the presence of distilled, purified or tap water at a temperature of 85-100° C. for a duration of 5-60 minutes optionally with low speed mixing (10-100 rpm). Thereafter the tobacco product is then removed from the water bath and dried, optionally under radiant heat for one hour. The product is then cut or ground into strips or pieces having a largest dimension of 50 to 2,000 microns, or more preferably 100 to 1,000 microns. Thereafter the cut or ground tobacco and/or herb product is combined with the water in which the tobacco and/or herb product was mixed ground tobacco product about 1:1 by weight with glycerin and allowed to sit for one hour.

In some embodiments, the suspension mixture is then portioned into packaging (116) for use with an electronic delivery device. This portioning process can occur, for example, by means of an automated machine, or by hand, or another delivery device.

Although described as a particular series of operations, in other embodiments, more or fewer steps may be involved, or the steps may be conducted in a different order. For example, in some embodiments, a plant material may be cut (104) prior to drying (102). In further embodiments, one or more of the additional ingredients (110), such as a preservative or flavor, may be added to the plant material prior to or after cutting and grinding (104) and before adding the plant material to the suspension (108). Rather than adding a measure of tobacco to the suspension components (108), in alternative embodiments, a measure of suspension components may be added to the plant material. Other modifications of the process 100 are possible while remaining within the scope and the intent of the process 100.

Figure 7A:
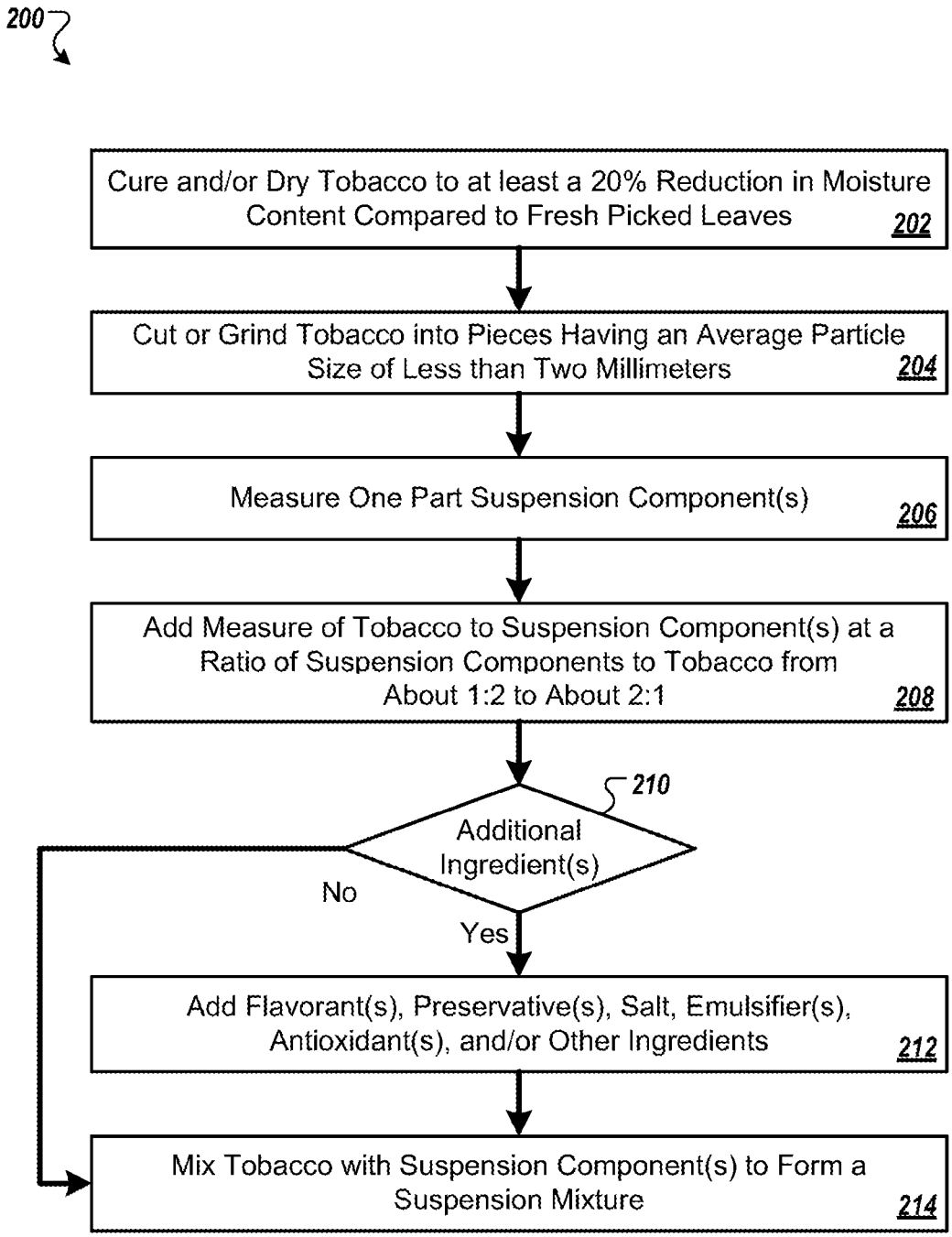
FIG. 7A is a flow diagram illustrating an example method for preparing a tobacco suspension.
Figure 7B:
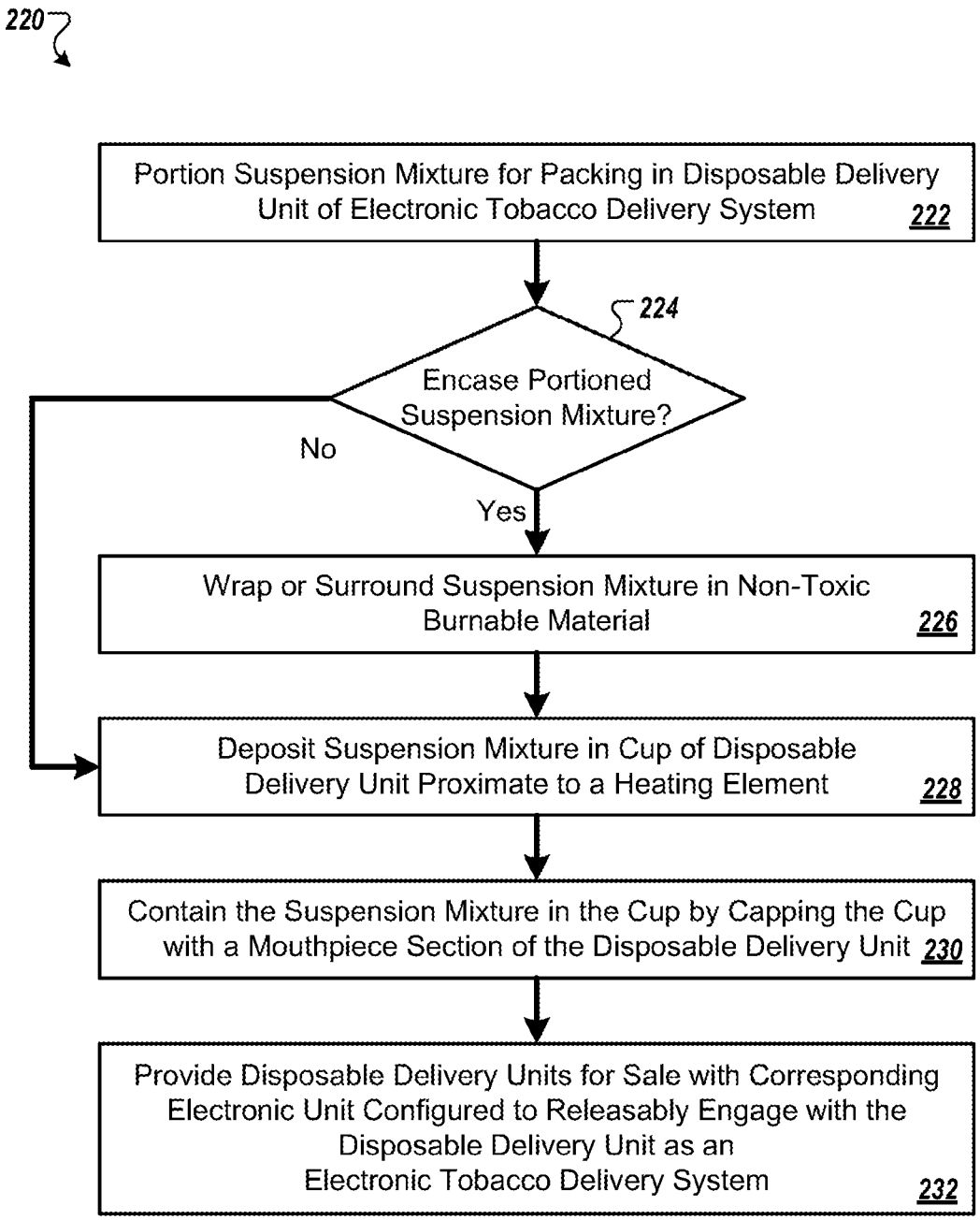
FIG. 7B is a flow diagram illustrating an example method for preparing disposable tobacco delivery units filled with a tobacco suspension.

FIG. 7A and FIG. 7B are flow charts showing another example processes 200 and 220 for preparing the materials and portioning into a packaged container. Turning now to FIG. 7A, in some implementations, the process 200 begins with curing and/or drying the tobacco (202) to have a reduction in moisture of at least 20% compared to fresh picked leaves. Several types of tobacco curing and/or drying processes can be used. In addition to whole tobacco leaves or the lamina sections of a tobacco leaf, other parts of the tobacco plant, such as stems, flowers, stalks, and roots can also be used. Ingredients can be added to the tobacco to improve the flavor during the curing process.

In some embodiments, the tobacco is cut or ground into pieces of less than two millimeters (204). The tobacco can also be ground to a rough or fine powder. Mixtures of tobacco pieces of different sizes can also be used. For example, a mixture of both ground tobacco powder and leaf pieces having an average size of about 1 mm can be used.

In some embodiments, a suspension component is measured (206), and the tobacco is added so that a ratio of tobacco to suspension components is from about 1:2 to 2:1 (208). The measurement can be done on a weight to weight basis. Alternatively, a volume measurement can be used. In an embodiment, the tobacco is mixed in a 1:1 ratio (w/w) with glycerin as the suspension component.

In some embodiments, the ingredients are mixed to form a suspension mixture (214). The mixing can occur over various temperatures. The mixing can occur, for example, at various mixing speeds. The ingredients can be added all at once, or one by one. In an embodiment, the ingredients are incorporated at a slow speed, then the speed is increased once the initial mixing occurs. The mixing can be performed, for example, by hand, by use of a machine, by use of an automated system, or a combination of these.

The various steps or preparing the tobacco suspension mixture can occur at different times, or in different combinations. For example, the tobacco cutting/pulverizing step can occur during the mixing process, if desired (such as by using a blender type apparatus for processing). The ratios of components can be adjusted as needed. The viscosity can be modified as needed, for example, for ease of packaging or for optimal delivery of the mixture to the user.

Turning to FIG. 7B (220), in some embodiments, the suspension mixture is portioned for packing into a disposable delivery unit of an electronic tobacco delivery system (222). The portioning process can be performed manually, or with machine assistance, or by an automated means. The portioning process can occur at room temperature, or at other various temperatures.

In some embodiments, the portion is encased (224) in a material, by wrapping or surrounding the suspension mixture in a non-toxic burnable (or dissolvable) material (226).

Figure 11A:
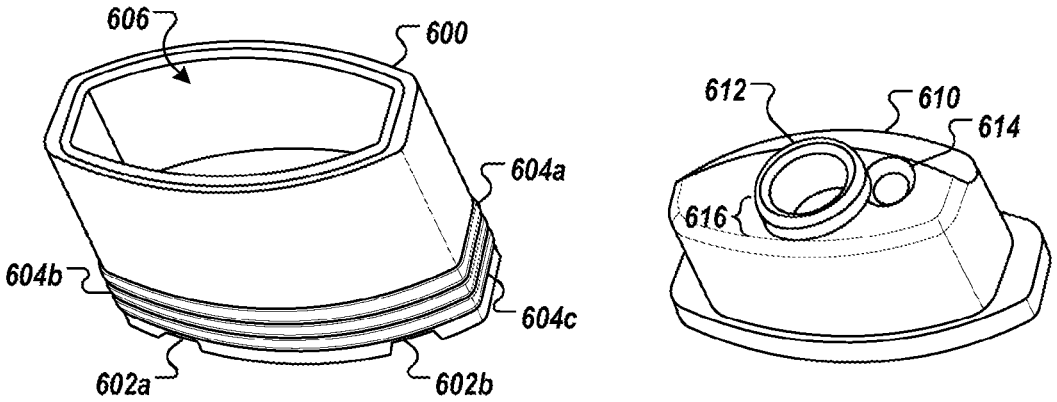
FIG. 11A and FIG. 11B illustrate example cup and cap designs of an electronic tobacco delivery device for receiving and holding a tobacco suspension.
Figure 11B:
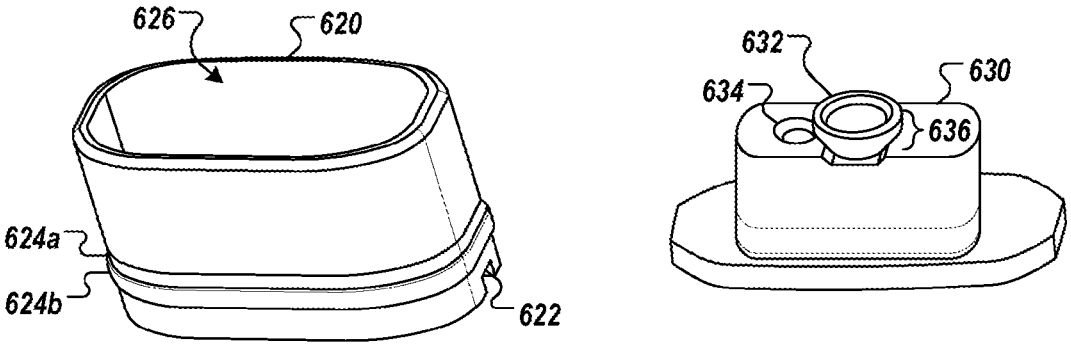

In some embodiments, the portion of suspension mixture is deposited into a cup of a disposable delivery unit that is proximate to a heating element (228). Example cups, in particular, are illustrated in FIGS. 11A and 11B. The individual portions can also be packaged in multiple portions, such as by using a "unit dose pack" or a "blister pack" to help keep individual portions stable and moist prior to use.

Figure 8A:
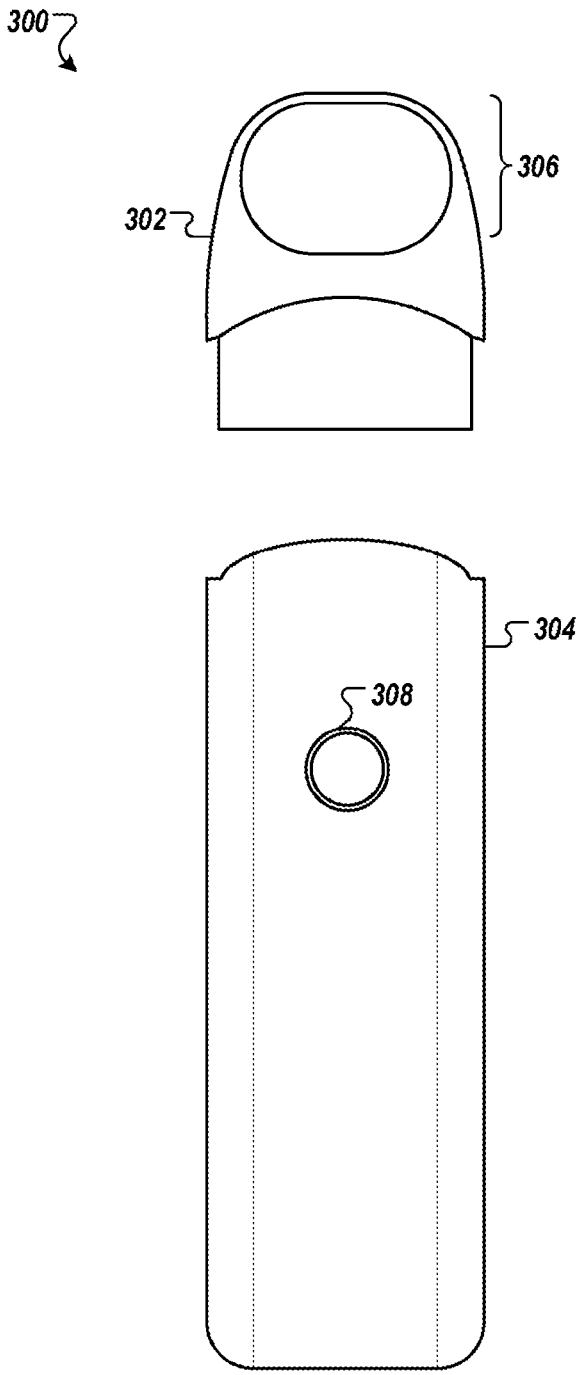
FIGS. 8A through 8C illustrate an example electronic tobacco delivery device for receiving and heating a tobacco suspension.
Figure 8C:
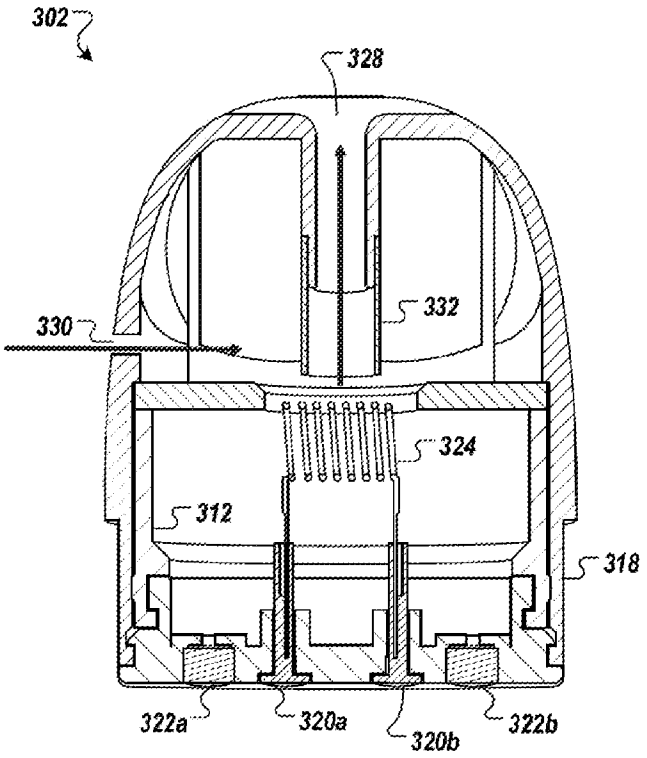
Figure 8B:
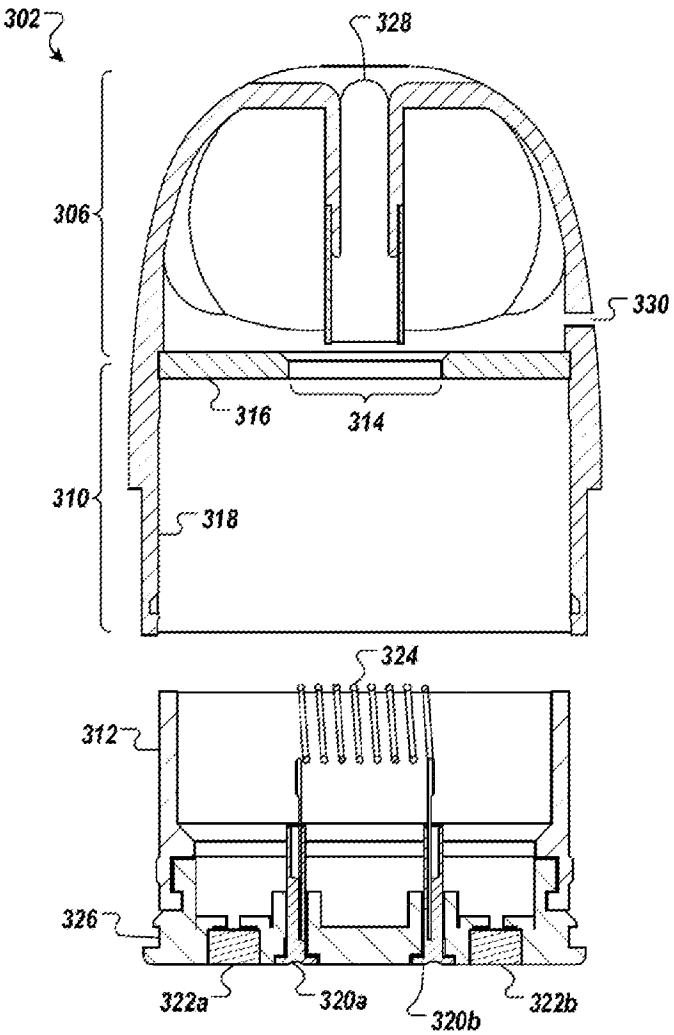

In some embodiments, the suspension mixture is contained by capping the cup with a mouthpiece section of the disposable delivery unit (230). As illustrated in FIGS. 8B and 8C, for example, a cup 312 (illustrated in an open view in FIG. 8B) may be provided for insertion of the suspension mixture. The cup 312 may then be capped by a section 310, resulting in the suspension mixture being held within the cup 312 beneath a cap section 316, as described in further detail below. Additional examples are illustrated in and described in relation to FIGS. 10A-D.

In some embodiments, the disposable delivery unit(s) are provided for sale with a corresponding electronic unit configured to releasably engage with the disposable delivery unit as an electronic tobacco delivery system (232). Example delivery devices are provided in FIGS. 8-13, described in greater detail below. The electronic unit, for example, may be sold with one or more disposable delivery units. Further, disposable delivery units may be sold individually or in packages for interoperable use with the electronic portion. Different suspensions may be sold individually or in multi-packs for users to sample different tobacco strains, cure types, flavors, suspension compositions (e.g., organic, flavored, scented, herb infused, etc.) with the electronic tobacco delivery system. Disposable units having two or more mouthpiece designs, such as the designs illustrated in FIGS. 8-13, may be available for interoperable use with a same electronic unit. Electronic units may be sold in different colors, materials, and/or designs to suit individuals' tastes. In additional implementations, a charging cord and/or docking unit may be sold with the electronic tobacco delivery system for recharging a battery with the base unit.

Various tobacco strains or mixtures thereof can be used to prepare the processed tobacco, including flue-cured tobacco, cigar-wrapper-binder, burley tobacco, Maryland, oriental tobacco, Pennsylvania, Cameroon, Cuban, Maduro, Negra, dark air-cured, fire-cured, reconstituted tobacco and processed tobacco stems or other parts of the whole tobacco plant.

Thus, in an embodiment, the tobacco is from *Nicotiana tabacum, Nicotiana rustica*, or a combination thereof. Several other species of *Nicotiana* can be used, either alone or in combination with other species. These other species include but are not limited to *Nicotiana acaulis, Nicotiana acuminata, Nicotiana alata, Nicotiana ameghinoi, Nicotiana arentsii, Nicotiana attenuata, Nicotiana azambujae, Nicotiana benavidesii, Nicotiana bonariensis, Nicotiana clevelandii, Nicotiana cordifolia, Nicotiana excelsior, Nicotiana forgetiana, Nicotiana glauca, Nicotiana glutinosa, Nicotiana knightiana, Nicotiana langsdorfii, Nicotiana linearis, Nicotiana longibracteata, Nicotiana longiflora, Nicotiana miersii, Nicotiana mutabilis, Nicotiana noctiflora, Nicotiana obtusifolia, Nicotiana otophora, Nicotiana palmeri, Nicotiana paniculata, Nicotiana pauciflora, Nicotiana petunioides, Nicotiana plumbaginifolia, Nicotiana raimondii, Nicotiana repanda, Nicotiana rosulata, Nicotiana setchellii, Nicotiana solanifolia, Nicotiana sylvestris, Nicotiana thyrsiflora, Nicotiana tomentosa, Nicotiana trigonophylla, Nicotiana undulata*, and *Nicotiana wigandioides*, or other nicotine-containing plants of the Solanaceae family, including but not limited to the *Hopwoodii* tree and other indigenous plants of Australasia and South America.

In a currently preferred embodiment, organic tobacco is used to the prepare the wet tobacco product. In an embodiment, the process may utilize organic (non-chemically altered) tobacco to ensure an optimally healthier product to an end-user.

The natural nicotine content of the tobacco material may depend upon the agronomic conditions under which the tobacco plant is grown as well as the genetics of the tobacco variety. The nicotine content in tobacco leaf material is typically about 1%-1.5% (10-15 mg nicotine per gram of tobacco). However, tobacco varieties such as those designated by the United States Agricultural Department (USDA) as Type 35, Type 36, or Type 37 have a high nicotine content. The tobacco species *Nicotiana rustica* often also has natural nicotine content in the range of about 6%-10%. Further, commercial lines of flue-cured tobacco, designated by the USDA as Types 11-34, and Burley tobacco, designated by the USDA as Type 31, have naturally high nicotine content, particularly in the leaves of the upper stalk.

In an embodiment, the tobacco material has a nicotine content of about 0.1%-1%, 1%-2%, 2%-3%, 3%-4%, 4%-5%, 5%-6%, 6%-7%, 7%-8%, 8%-9%, 9%-10%, 10%-11%, 11%-12%, 12%-13%, 13%-14%, 14%-15%, 15%-16%, 17%-18%, 18%-19% or 19%-20%. In yet another embodiment, less than 0.1% or no nicotine is present in the tobacco.

Other types of plants can be used, in addition to or instead of tobacco. Examples include but are not limited to tea leaves, mint leaves, sage, yerba mansa (*Anemopsis californica*), yerba manta, marshmallow, rose petals, mullein, catnip, clover, *Cannabis* sp., cloves, and other suitable herbal plants. The plants, for example, may be selected for particular holistic or medicinal value. In another example, the plants may be selected for flavor or scent purposes. In a further example, the plants may be selected for traditional, religious, or ethnic value, such as native plants used in ceremonial smoking compounds by indigenous groups, such as the *Hopwoodii* species of Australasia and Amazonia.

Tobacco material (leaves, lamina, stems, veins, flowers, roots and/or midribs) can be dried, partially dried, or cured using various means, or combinations thereof, such as air drying, vacuum drying, microwave energy, sunlight energy, an oven, fluid bed dryers, tray dryers, belt dryers, vacuum tray dryers, spray dryers, and rotary dryers.

In some embodiments, the tobacco leaf drying process can be a curing process. Among the exemplary types of cured tobacco are flue-cured tobacco, dark air-cured tobacco, fire-cured tobacco, reconstituted tobacco and processed tobacco stems.

The drying step can reduce the moisture in the leaves from about 10%, 15%, 20%, 25%, 30%, 35%, 40%, 45%, 50%, 55%, 60%, 65%, 70%, 75%, 80%, 85%, 90%, 95%, or greater.

The drying step or curing step can occur with constant mixing, intermittent mixing, or without mixing of the tobacco starting material. In some embodiments, the drying step occurs relatively slowly, over several days, to allow natural flavors to develop. For example, the drying step may take from about 2 hours, 8 hours, 12 hours, 16 hours, 14 hours, 36 hours, 48 hours, 2 weeks, 3 weeks, or 4 weeks or more. The drying step can occur at a temperature of from about 4° C., 6° C., 8° C., 10° C., 12° C., 20° C., 50° C., 70° C. or more. In another embodiment the leaves are freeze-dried to dry the material quickly without the development of additional flavor.

In an embodiment, the temperature at which the drying step is conducted is at or below ambient temperature. In certain embodiments, the drying process includes heating the plant or portions thereof at elevated temperature. The temperature can range, from about room temperature to about 200° C. In another embodiment, the tobacco can be dried using a freeze-drying step.

Although described in relation to tobacco material, in certain embodiments, various processing means may be used to process other types of plants, for example plants identified above.

The tobacco used in this process can be cut to various sizes, using several types of cutting means. Also, the grinding/cutting action applied to the raw tobacco leaves may be performed manually or via machine means.

Exemplary cutting means include but are not limited to blending, grinding, pulverizing, mincing, shredding, milling, pulverizing and chopping. The tobacco pieces can be cut to various sizes. For example, the pieces can have an average diameter of from about 0.1 mm, 0.25 mm, 0.5 mm, 0.75 mm, 1.0 mm, 1.2 mm, 1.5 mm, 2 mm, 3 mm, 4 mm, and about 5 mm. In some embodiments, the tobacco can also be ground into the form of a powder. A combination of cutting, grinding, or pulverizing means can also be utilized. In another embodiment, the tobacco can be a combination of small pieces and finely ground tobacco.

The dried tobacco product may be cut or ground into strips or pieces having a largest dimension of 50-2,000 microns, or more preferably 100-1,000 microns. In certain embodiments, the size of the tobacco product particles, pieces, strips, or grounds has an average largest dimension or diameter of about 50-100, 100-200, 200-300, 300-400, 400-500, 500-600, 600-700, 700-800, 800-900, 900-1,000, 1,000-1,100, 1,100-1,200, 1,200-1,300, 1,300-1,400, 1,400-1,500, 1,500-1,600, 1,600-1,700, 1,700-1,800, 1,800-1,900, or 1,900-2000 microns.

Although described in relation to tobacco, in certain embodiments, the cutting means may be used to cut other types of plants, as listed in examples provided above.

To prepare the tobacco product, the cut/ground tobacco discussed above is mixed with a solvent or "suspension agent." The solvent or suspension agent, for example, may be in a liquid or gel form. In another example, the solvent or suspension agent may be a stable emulsion. Exemplary solvents or suspension agents include but are not limited to water, propylene glycol (PG), polyethylene glycol, vegetable oil, glycerin and polysorbate 80 and mixtures thereof. In a currently preferred embodiment, the solvent or suspension agent is pure glycerin.

The ratio of tobacco to suspension agent (w/w) can be from about 3:1, 2:1, 1.5:1, 1.2:1, 1:1, 1:1:1.2, 1:1.5, 1:2 or 1:3 or values therebetween. In a currently preferred embodiment, the ratio is about 1:1.

In an embodiment, after the tobacco has been combined with the suspension agent, water is optionally added to the mixture. For example, in an embodiment, from about 1%, 5%, 7%, 10%, 15%, 20%, 25%, 30%, 40%, 50% or 60% water (w/w) can be added to the mixture.

In a currently preferred embodiment, the final resulting tobacco product which is inserted into the heat-not-burn device is organic and is a mixture of three components: water, glycerin, and tobacco. The tobacco product can include about 20%-25%, 25%-30%, 30%-35%, 35%-40%, 40%-55%, 50%-55%, 5%5-60%, 60%-65%, 60%-65%, 65%-70%, 70%-75%, or 75%-80% glycerin by weight. The tobacco product can include about 1%-5%, 5%-10%, 10%-15%, 15%-20%, 20%-25%, 25%-30%, 30%-35%, 35%-40%, or 40%-50% water by weight or values therebetween. The tobacco product can include about 1%-5%, 5%-10%, 11%, 12%, 13%, 14%, 15%, 16%, 17%, 18%, 19%, 20%, 21%, 22%, 23%, 24%, 25%-30%, 30%-35%, 35%-40%, or 40%-50% tobacco by weight or values therebetween. In a currently preferred embodiment, the product consists of about 65%-75% glycerin, 5%-15% water, and 20% tobacco by weight or values therebetween.

In a currently preferred embodiment, the composition is of a flowable, relatively thick jam-like consistency. The viscosity of the tobacco product may be between about 5,000 and 80,000 cp. In various embodiments, the viscosity is about 5,000-10,000, 10,000-20,000, 20,000-30,000, 30,000-40,000, 40,000-50,000, 50,000 to 60,000, 60,000-70,000, or 70,000-80,000 cp. In the embodiment which is currently most preferred, the viscosity is between about 20,000-50,000 cp.

The amount of tobacco product inserted in the cup of each delivery device may be about 0.1-0.25, 0.25-0.5, 0.5-0.75, 1, 1-1.25, 1.25-1.5, 1.5-1.75, 1.75-2, 2-2.25, 2.25-2.5, 2.5-2.75, 2.75-3.0, 3-3.25, 3.25-3.5, 3.5-3.75, 3.75-4, 4-4.25, or 4.25-4.5 grams. Currently preferred embodiments use about 1-2.5 mg tobacco product in each cup of a delivery device.

In contrast to conventional heat-not-burn devices, the most preferred embodiments exemplified herein contain about 20% of tobacco material by finished weight. IQOS and other heat-not-burn devices contain about 25-35% tobacco by weight. Even moist tobacco products such as snuff and hookah tobacco use substantially different tobacco content. Moist snuff typically contains about 24%-35% tobacco by weight and hookah tobacco typically contains around 10-15% tobacco by weight. Whereas wet hookah tobacco is typically cut into strips, the embodiments exemplified herein utilize a wet tobacco product formed from ground tobacco leaves.

In contrast to the exemplified embodiments, conventional heat-not-burn devices use dry tobacco product in order to promote heating and aerosolization of the tobacco product. Aerosolization of the tobacco product requires air, and thus each of the conventional products provided dry tobacco product through which air can flow relatively freely, as in a traditional cigarette. In conventional vaping devices, wicks are used to draw nicotine-containing liquid into an air stream which ensures that the liquid is fully aerated during the aerosolization process.

Immersing the heating element in a wet mixture of tobacco and suspension agent(s) was not previously considered feasible because the wet tobacco product was expected to smother the heating element and impede or prevent effective aerosolization. Indeed, the applicant has found that in many potential embodiments the heating element is in fact smothered.

As shown below in Comparative Example 1, if the tobacco product is too wet or too much of it surrounds the heating element, one or more of the following problems are encountered. First, as noted above the heating element may be smothered, preventing effective aerosolization. In the absence of oxygen, pyrolysis causes decomposition of the tobacco product proximate the heating element which substantially impedes or prevents the desired aerosolization of the tobacco product. A layer of decomposed or carbonized tobacco product may cover the heating element, essentially terminating the desired aerosolization process.

Second, only a small portion of the wet mixture of tobacco and suspension agent(s) (hereinafter alternatively called the "the tobacco product") may be consumed relative to the total amount contained in the cup, pod or reservoir. Even if some aerosolization occurs, much or most of the tobacco product may be wasted.

Third, the aerosolization may occur for an insufficient number of puffs before the foregoing mechanisms bring the desired aerosolization process to a halt. For example, use of a mixture tobacco and suspension agent(s) that is too wet or too dry may produce a result wherein the user can achieve only 1-5, 1-10 or 1-20 puffs per cup, pod or dose, which is typically 1-3 grams of tobacco product as discussed above. Although that may be equivalent to a cigarette and the IQOS device, it still leaves much of the tobacco product unused and is therefore less desirable. By controlling the viscosity of the tobacco product as taught herein, the tobacco product and device disclosed herein may provide 10, 20, 30, 40, 50, 60, 70, 80, 90, 100, 110 or 120 puffs per gram of tobacco product or values therebetween. In the most preferred embodiments, 120 puffs per gram of tobacco product are produced. That exceeds the puffs-per-gram achieved by conventional heat-not-burn devices by a at least a factor of three.

Fourth, the heating element may need to be raised to an elevated temperature, such as approaching or exceeding 300 degrees Celsius, in order for aerosolization to occur. At such temperatures, elevated levels of HPHCs are typically produced. According to research published by a large tobacco manufacturer, relative to cigarette smoking HPHCs are reduced in heat-not-burn devices by 99% if the tobacco product is heated to only 150° C., by 95% if the tobacco product is heated to only 200° C., by 93% if the tobacco product is heated to only 220° C., and by 90% if the tobacco product is heated to 300° C. It can be projected from published data that relative to cigarette smoking HPHCs are reduced by about 80% if the tobacco product is heated to around 400° C.

It is important to note that these stated HPHC reductions are only with respect to known HPHCs and do not account for compounds of unknown toxicity. As discussed above, the addition of numerous flavorants is suspected to generate acetals and many other compounds of unknown toxicity in known heat-not-burn devices.

To restate the HPHC reductions created by use of lower temperatures in heat-not-burn devices, heating the tobacco product to 200° C. reduces the HPHC production by a factor of two relative to heating the tobacco product to 300° C. and a factor of four relative to heating the tobacco product to about 400° C. Heating the tobacco product to 100° C. reduces the HPHC production by a factor of three relative to heating the tobacco product to 300° C. and a factor of six relative to heating the tobacco product to about 400° C.

Again, the actual reduction is likely far greater when one considers the fact that lower temperature heating also reduces the production of many compounds of unknown toxicity. For example, acetals produced by heating PG in the presence of common flavorants as in the IQOS product are believed to be carcinogenic.

The applicant has discovered that, surprisingly, it is possible to aerosolize wet tobacco product even when the heating element is substantially surrounded by the wet tobacco product. The applicant also discovered that, in order to achieve aerosolization of wet tobacco product, it is advantageous to carefully control the viscosity of the composition and the manner in which it contacts the heating element and to simultaneously control the construction and mechanism of operation of the pod contained in the inhaling device.

Applicant found that at certain wet tobacco viscosities it is possible to enclose the tobacco product with a deformable or collapsible pod that substantially enhances the aerosolization of the tobacco product. For instance, a pod having a silicone cup with a wall thickness on the order of 1 mm may be used. Alternatively, wall thicknesses may be about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 or 2.0 mm or values therebetween.

While not wishing to be bound to a particular theory, it is believed that during inhalation the pod wall partially collapses or changes shape, thereby drawing the wet tobacco product into intimate contact with the heating element. The flexible walls of the pod are pulled inward by the suction provided by the inhalation. The walls are preferably designed to deform at a negative pressure of about 1 to 20 millibar (mb). In various embodiments, the pod walls deform at a pressure of about 1, 2, 3, 4, 5, 6, 7, 8, 9, 10, 12, 14, 15, 18, 20, 25, 30, 35, 40, 45 or 50 mb or values therebetween.

After suction is removed, the pod expands to its original shape, which advantageously draws air into the interstices of the high viscosity tobacco product. The viscosity of the tobacco product is advantageously controlled to be around 10,000 to 50,000 cp to facilitate this mechanism of action. This process aerates the tobacco product in a reciprocating action that is similar to that performed by a bellows, except that the area of interest is by analogy inside the bladder of the bellows.

During the next inhalation the user presses the button on the device and the element is heated. The deformation of the pod wall brings the tobacco product once again into intimate contact with the heating element. The aerated tobacco product is then ready for another aerosolization step, which typically lasts several seconds as the user inhales while pressing the button to activate the heating element.

In this fashion the pod wall can substantially improve the aeration and aerosolization of the tobacco product. Careful control of these parameters has been shown to generate a three-fold improvement in tobacco product aerosolization/usage which in turn creates a more satisfying vapor and better taste. That, in turn, provides a degree of user satisfaction that is sufficient to displace or replace smoking of traditional cigarettes. Conventional heat-not-burn devices have been unsuccessful in this regard, in substantial part due to their inferior aerosolization and increased HPHC production.

The devices described herein are in the most preferred embodiments capable of achieving aerosolization at very low temperatures, on the order of 100° C. which reduces HPHCs as much as 4, 5 or 6 times or more relative to conventional heat-not-burn products such as IQOS. The overall reduction of actual carcinogens (i.e., known HPHCs and compounds of unknown toxicity that are in fact carcinogenic) is likely much greater, on the order of 7, 8, 9 or 10 times or greater.

In preferred embodiments, the user presses the heater button for about one to five seconds (or values therebetween), while inhaling, which produces a "puff" about one to three seconds of durations because the aerosolization process begins almost immediately upon application of heat, when the tobacco product achieves a temperature of about 75-85° C., which occurs about 0.5 second into the process. A puff or heating cycle (the period during which the user depresses the heating button and inhales) may last about 0.5, 1, 1.5, 2, 2.5, 3, 3.5, 4.5, 5, 6, 7, 8, 9 or 10 seconds or values therebetween. In a further preferred embodiment, a puff or heating cycle may last for about five seconds or less.

Over the course of the heating process the temperature of the tobacco product about one millimeter from the heating element is elevated to a temperature of about 125° C. In certain embodiments, over the course of the heating process the temperature of the tobacco product about one millimeter from the heating element is elevated to a temperature of about 100° C., 110° C., 120° C., 130° C., 140° C., 150° C., 160° C., 170° C., 180° C., 190° C., 200° C., 210° C., 220° C., 230° C., 240° C., or 250° C. or values therebetween. In certain embodiments, over the course of the heating process the temperature of the tobacco product about two millimeters from the heating element is elevated to a temperature of about 100° C., 110° C., 120° C., 130° C., 140° C., 150° C., 160° C., 170° C., 180° C., 190° C., 200° C., 210° C., 220° C., 230° C., 240° C., or 250° C. or values therebetween. In certain embodiments, over the course of the heating process the temperature of the tobacco product within 0.5 mm of the heating element is elevated to a temperature of about 100° C., 110° C., 120° C., 130° C., 140° C., 150° C., 160° C., 170° C., 180° C., 190° C., 200° C., 210° C., 220° C., 230° C., 240° C. or 250° C. or values therebetween.

As noted above, increased temperatures may result in increased emissions of harmful products. Thus in certain embodiments the heating controller may be configured to supply heat only for a certain period of time after the button is depressed, for instance about 0.5, 1, 1.25, 1.5, 1.75 or 2 seconds or values therebetween, to limit the heating of the tobacco product to a desired temperature range of about 100° C. to 125° C. Alternatively, current to the heating element may be turned on and off during a single button press to permit heat to more evenly distribute throughout the tobacco product. The wet tobacco product enhances heat transfer laterally throughout the tobacco product, which permits more uniform heating of the tobacco product. That in turn allows the tobacco product to be aerosolized preferentially at a relatively low and controlled temperature compared to known heat-not-burn devices.

While not wishing to be bound to a particular theory, it is believed that there are two mechanisms of action in the currently preferred embodiments. First, the solid ground tobacco product (which contains both glycerin and water) is heated and aerosolized. Second, at the interface of the heating element and the liquid suspension agent (which is mixture of glycerin, water and natural components dissolved from the ground tobacco) boils. This can occur at temperatures of 101° C. to 170° C., depending on the relative concentrations of glycerin, water, and other solutes. In certain embodiments, this boiling occurs about 110° C.-120° C., 120° C.-130° C., 130° C.-140° C., 140° C.-150° C., 150° C.-160° C. or 160° C.-170° C. or values therebetween. In this embodiment, this boiling effect may be highly localized to the heating element, depending on the viscosity and composition combined with the level of agitation of the tobacco material in the liquid caused by suction and release on inhalation, thereby contributing to the overall aerosolization process without substantially increasing HPHC emission caused by excessive heating or pyrolysis of the tobacco product as in conventional heat-not-burn devices.

This dual mechanism of action (aerosolization of both solid tobacco product and liquid containing water, natural tobacco extract and glycerin) is unique to the embodiments described herein and is distinct from existing heat-not-burn products. As discussed above, conventional heat-not-burn products provide the tobacco product in a dry form that permits active flow of air or a mixture of air and water vapor through a heated dry tobacco product during inhalation.

The exemplified embodiments are also a fundamental departure from known vaping products, which use a wicking system to bring nicotine containing liquid into an air stream where it is heated. Also, in contrast to conventional vaping products, the aerosolized product is real tobacco and contains no added nicotine. This avoids the increased risk of addiction and short-term health effects reported in connection with modern vaping devices.

Also, unlike conventional heat-not-burn or vaping products, currently preferred embodiments described herein provide an improved taste and user experience that is more likely to replace smoking of traditional cigarettes, which is the stated goal of heat-not-burn devices. Preferred embodiments of the instant invention provide an improved taste and user experience that is likely to replace traditional cigarettes without the added nicotine, associated addiction risk, and short-term health effects of vaping and without the elevated HPHC levels associated with conventional heat-not-burn devices.

As detailed in the examples section below, in a smoke test involving twenty-one participants who sampled the IQOS Heatstick and an embodiment of the invention exemplified herein, the product of the invention was deemed to provide far improved taste and ease of use. As to taste, on a scale of 1 to 5 (5 being best) IQOS received a rating of 1.27 (1 being worst) and the embodiment of the invention exemplified herein was given a rating of 4.55 (5 being best). For ease of use, IQOS received a rating of 1.05 (1 being worst) compared to 4.95 (5 being best) for the preferred embodiment of the invention exemplified herein. None of the twenty-one smoke test participants was aware of any affiliation between the administrator of the study and either of the products.

Use of a pasteurization process for the tobacco advantageously preserves the tobacco product without the addition of a preservative agent. As discussed at length above, heating of mixtures of compounds to temperatures in excess of 100° C. can produce carcinogenic compounds and compounds of unknown toxicity. Thus, it is most preferred that an organic pasteurized tobacco be utilized to prepare the tobacco product.

In some embodiments, the packaged tobacco product is used as part of an electronic tobacco delivery system (ETDS) including an electronic tobacco delivery device for heating and converting the packaged tobacco product into a smoke or vapor state. Turning to FIG. 8A, in some embodiments, an electronic tobacco delivery device 300 includes a disposable delivery portion 302 for receiving and heating a tobacco suspension and a non-disposable body or electronics portion 304 housing a power source and electronics for activating a heating mechanism of the electronic tobacco delivery device 300 to deliver a smoke or vapor to the end user via a mouthpiece section 306 of the electronic tobacco delivery device 300. As illustrated, the delivery portion 302 is separated from the electronics portion 304. In some implementations, the delivery portion 302 is releasable from the electronics portion 304 to add the tobacco product to the electronic tobacco delivery device 300. For example, the delivery portion 302 may be releasable to refill a product cup with more tobacco product. In some but not all implementations, the delivery portion 302 is disposable. For example, the delivery portion 302 may be pre-filled with tobacco product as the tobacco product packaging and sold as a "pod" or dose. Further to the example, after use, the delivery portion 302 may be disposed and replaced with a new delivery portion 302.

Turning to FIG. 8B, a cross-sectional view of the delivery portion 302 illustrates a cap section 310 beneath the mouthpiece section 306. The cap section 310, as illustrated, is designed to nest with a product cup section 312. The wet tobacco product described in detail above is added to the cup 312 such that the tobacco product fills the cup 312 to the top edge of the cup and leaves the uppermost portion of heating element 324 exposed.

The pod is dimensioned to hold a desired amount of tobacco product and provide the desired degree and uniformity or cyclicality of heating to the tobacco product. The overall width of the cup 312 may be 15, 16, 17, 18, 19, 20, 21, 22, 23, 24, 25, 26, 27, 28, 29, or 30 mm or values therebetween. The width of the cup (measured along the z-axis, into and out of the page in FIG. 8C) may be 5, 6, 7, 8, 9, 10, 11, 12, 13, 14, 15, 16, 17, 18, 19, or 20 mm or values therebetween. The wall of the cup 312 may be formed of silicone and have a wall thicknesses of about 0.1, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9 or 2.0 mm or values therebetween.

Doses of tobacco product contained in the cup may be about 0.1-0.25, 0.25-0.5, 0.5-0.75, 1, 1-1.25, 1.25-1.5, 1.5-1.75, 1.75-2, 2-2.25, 2.25-2.5, 2.5-2.75, 2.75-3.0, 3-3.25, 3.25-3.5, 3.5-3.75, 3.75-4, 4.25, or 4.50 grams or values therebetween. Currently preferred embodiments use about 1-2.5 mg per pod or dose.

The volume of the cup 312 may be 100 to 15,000 $mm^3$. In preferred embodiments, volume of the cup 312 may be about 1,000, 1,500, 2,000, 2,500, 3,000, 3,500, 4,000, 4,500, 5,000, 5,500, 6,500, 7,000, 7,500, 8,000, 8,500, 9,500, or 10,000 $mm^3$ or values therebetween.

The heating element 324 may be a 0.5, 1, 1.5, 2, 2.5, or 3 ohm (or values therebetween) resistive element that receives a 5, 6, 7, 8, 9, 10, 11, 12, 13, 14, 15, 16, 17, 18, 19 or 20 watt (or values therebetween) supply from a battery housed in body 304. In the embodiments exemplified herein the heating element is a 1.5 nickel chromium alloy fed by a 14 W supply of electricity from a 1200 mAh battery.

FIG. 8C illustrates the product cup section 312 nested in the cap section 310. The cap section 310 includes an outlet 314 in a cap 316. The outlet 314 is aligned with a mouthpiece outlet 328 to deliver smoke or vapor to the user. When nested (as in FIG. 8C), the cap 316 may cover the cup region 312 except for an opening of the outlet 314. The outlet 314, for example, may be round or oval-shaped. The outlet 314 may be substantially centrally located, as shown, within the cap section 310. To avoid spilling of tobacco product upon tipping the electronic tobacco delivery device 300, in some implementations, the tobacco product is produced in a manner that achieves the viscosities discussed above. The cap 316 may be flexible or deformable to press against one or more surfaces of the mouthpiece section and/or the cup 312 to create a seal. The cap 316, for example, may be formed from a high temperature food grade elastomer, such as a heat-resistant silicone, ethylene propylene diene monomer (EPDM) rubber, nitrile rubber (NBR), or fluoroelastomer (FKM, FPM). Conversely, in some embodiments, an interior wall 318 of the cap section 310 (e.g., within which the cup 312 nests) is formed of a rigid material, such as a plastic or metal. As illustrated in FIG. 8C, the heating element 324 is disposed partially in the outlet of the cap 314.

Returning to FIG. 8B, in some embodiments, the cup 312 is deformable such that it can expand to be packed with tobacco product and then retract while the tobacco product is being aerosolized. The deformable cup 312, for example, may urge the tobacco product toward a heating element 324 (e.g., a heating coil) while the electronic tobacco delivery device 308 is in use and negative pressure is applied to the interior of the cup 312. The cup 312, for example, may be formed from a high temperature food grade elastomer, such as a heat-resistant silicone, ethylene propylene diene monomer (EPDM) rubber, nitrile rubber (NBR), or fluoroelastomer (FKM, FPM).

In selected embodiments, the cup 312 may be preformed to have a shape that does not match opening 318 in that the walls are bowed inwards toward the heating element in one or more places when in a resting or unfilled state. In this embodiment, when the cup is filled with tobacco product and the cup is installed into the mouthpiece as shown in FIG. 8C, the elastic nature of the walls will provide an inwardly biasing force on the tobacco product that urges it toward the heating element. The amount of inwardly biasing force will be a function of the resting configuration of the cup walls and the extent to which they must be pushed outwards in order to accommodate the tobacco product. This "inwardly projecting wall" approach can be used to enhance the bellows effect described above and in further detail below.

As illustrated, the heating coil 324 is horizontally positioned. In other embodiments, the heating coil maybe vertically aligned, such as a heating coil 344 shown in FIG. 8D.

Referring to FIGS. 8A and 8C, in use the user presses button 308 while inhaling. The inhalation draws air through aperture 330 as indicated by the arrow therethrough. Air is drawn across the top of heating element 324, which is preferably at least partially exposed. The tobacco product is aerosolized, preferably according to the dual method of action described above. During inhalation, the wall of the cup 312 optionally bow inward and bring the tobacco product into contact with the heating element 324. This action becomes increasing important at certain tobacco viscosities as the tobacco product is consumed and the cup is only partially filled with tobacco product. In many implementations the tobacco product proximate the heating element 324 is consumed first. The bellows like action of the cup 312 helps bring tobacco product which may be clinging to the walls of the cup 312 into intimate contact with the heating element. Still further, the volume of the cup is reduced, which will tend to cause the liquid of the glycerin/water solution to rise higher around the heating element, which can increase the boiling mechanism of action discussed above. The aerosolized components of the tobacco product are carried out aperture 328 and inhaled by the user.

When inhalation ceases, the walls of cup 312 return to their normal shape (they are no longer bowed inward unless the cup is designed with inwardly projecting wall), which increases the volume of the cup and draws air into the cup area. This bellows-like action aerates the tobacco produce in preparation for the next draw or puff.

Figure 8D:
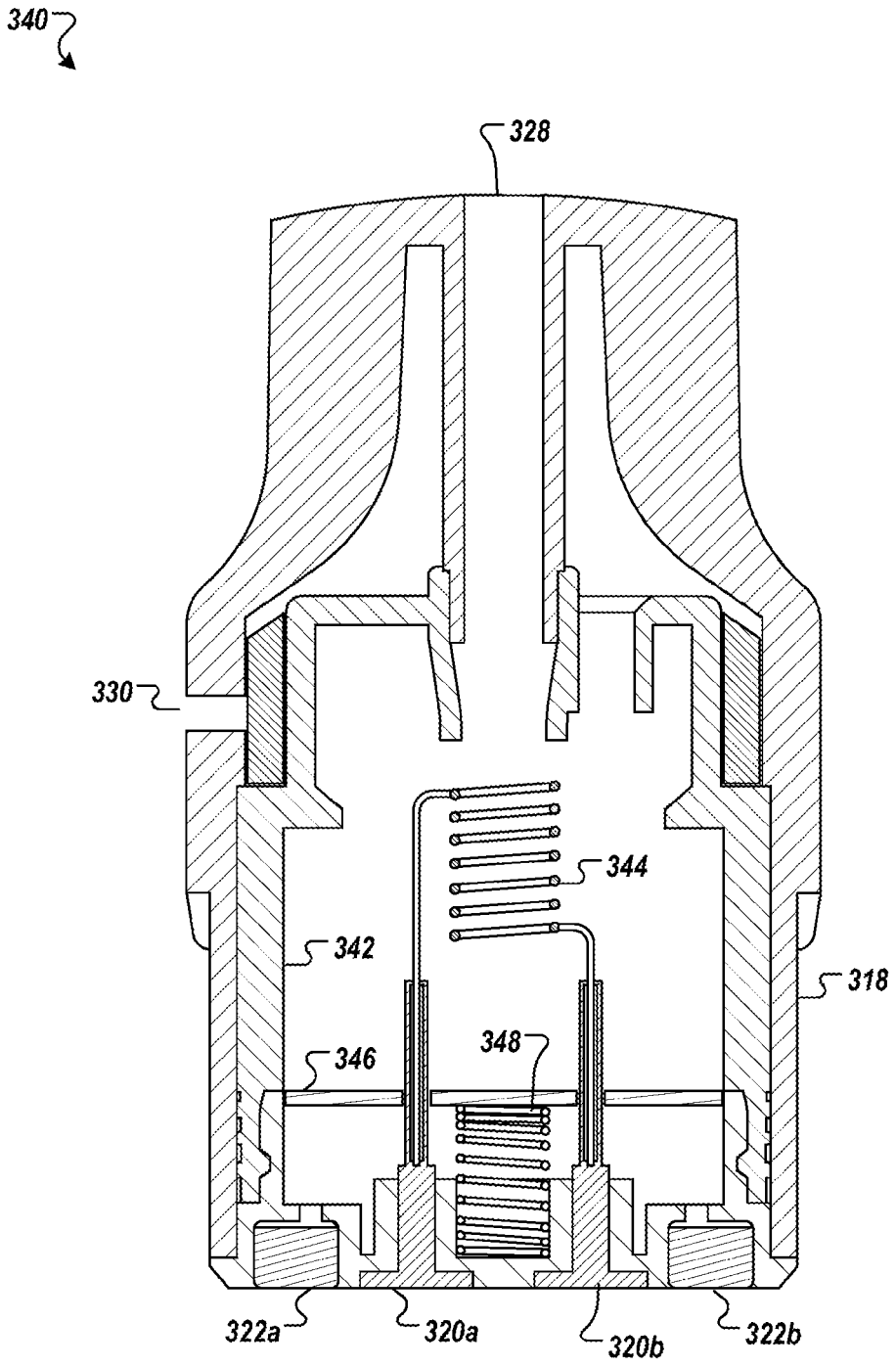
FIG. 8D illustrates an example delivery unit for use with an electronic unit of an electronic tobacco delivery device such as the device of FIG. 8A.

Turning to FIG. 8D, in some implementations, a cup 342 includes a movable floor 346 biased by one or more biasing elements such as a coil spring 348. In other embodiments, the biasing element(s) may include two or more coil springs, one or more leaf springs, or other compressible shape memory material such as a foam. The cup 342 may be deformable as described in relation to FIG. 8B or may be formed of more rigid material, such as a rigid heat-resistant silicone, metal, or other high temperature food grade elastomer. When initially filled with tobacco product, the spring 348 is in a fully compressed state. As tobacco product is consumed, the weight against the movable floor 346 is lessened and the movable floor 346 lifts the remaining tobacco product toward a heating coil 344. In other embodiments, rather than using a biasing member, the movable floor 346 may be manually raised by a user, for example through an externally disposed actuating mechanism (e.g., thumb wheel, slide mechanism with detents, etc.). In this manner, the alternative construction of FIG. 8D helps promote aerosolization, complete consumption of the tobacco product, and the dual mechanism of action described above.

Returning to FIG. 8B, a bottom region of the cup 312, in some embodiments, houses a set of electrodes 320 *a,b*. The electrodes 320*a,b*, for example, may supply electricity to the heating element 324 from a power supply enclosed in the electronics portion 304. For example, the electrodes 320 *a,b* may be in electrical connection with one or more disposable batteries, such as AAA or AA batteries, housed in the electronics portion 304. Alternatively, the electrodes 320*a,b* may be in connection with one or more rechargeable batteries housed in the electronics portion 304, such as a 18650 lithium ion battery, a 26650 lithium ion battery, or a 20700 lithium ion battery. A charging port (not illustrated) may be included in the electronics portion 304 for recharging the rechargeable type battery.

In some embodiments, the bottom region of the cup 312 houses one or more magnets 322*a,b*. The magnets 322*a,b*, for example, may be used to releasably engage the delivery portion 302 with the electronics portion 304 by magnetizing to corresponding magnets (not illustrated) in the electronics portion 304. The magnets 322*a,b*, in some implementations, are two discrete magnets. In other implementations, the magnets 322*a,b* are portions of a ring-shaped magnet surrounding the electrodes 322*a,b*. In alternative embodiments, a latching mechanism such as a spring latch or detent to ensure proper alignment of the delivery portion 302 with the electronics portion 304. For example, this may align the electrodes properly with corresponding power connectors in the electronics portion 304 (not illustrated).

Returning to FIG. 8A, in use, a user may depress an activation button 308 to direct energy to the heating coil 324 of FIGS. 8B and 8C. The activation button 308, in some embodiments, is held down during use of the electronic tobacco delivery device 300. The delivery of current to the heating element while the button is depressed may be controlled as discussed above.

The cup 312 may be provided with a temperature probe to facilitate this control. The probe may be mounted directly to an outer surface of electrodes 320 *a,b* or may project to the body of the cup interior so as to measure the temperature of the tobacco product at a desired location consistent with the foregoing teachings concerning aerosolization temperatures.

In some implementations, an inlet 330 in the side of the mouthpiece region 306 draws outside air into the electronic tobacco delivery device 300 to aerate the delivery portion 302. The inlet 330 may include a filter (not illustrated) or screen to keep out contaminants. In other embodiments, the inlet 330 may be designed as a collection of small inlets or openings, for example laid out in a decorative pattern, to allow air movement within the delivery portion 302 while reducing the likelihood of product leakage and/or introduction of external contaminants such as pet fur.

In some implementations, the mouthpiece outlet 328 includes a filter 330 for filtering the smoke or vapor produced by the heating coil 324 and/or for blocking leakage of the tobacco suspension from the cup 312. The filter 330, in some embodiments, includes a natural or manmade fiber such as cotton. In some embodiments, the filter includes one or more minerals such as charcoal or carbon. In further embodiments, the filter includes cellulose acetate (CA) nanocrystalline cellulose (NCC), or a hollow-acetate-tube (HAT). In further embodiments, the filter 330 is an electrostatic or electrolytic filter. Although illustrated as two separate components, in further embodiments, the heating coil 324 may be combined with the filter 314 to heat and filter the smoke or vapor prior to inhalation by the user.

Figures 9A, 9B:
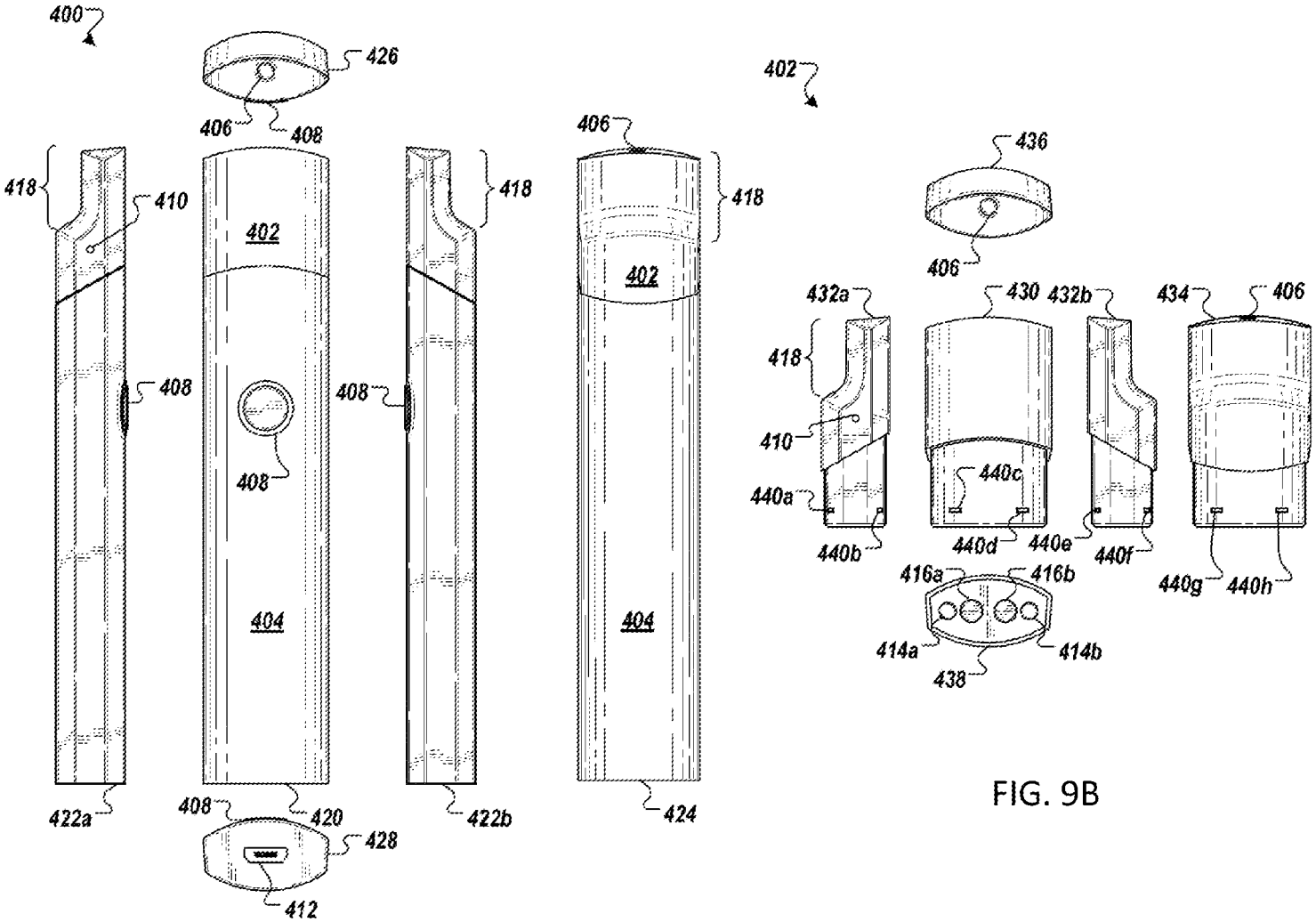
FIG. 9A and FIG. 9B illustrate a first example external design of an electronic tobacco delivery device.

FIGS. 9A through 9D illustrate alternative embodiments of an electronic tobacco delivery similar to the device 300 of FIGS. 8A-8D. Turning to FIG. 9A, a first example electronic tobacco delivery device 400 includes a delivery portion 402 and an electronics portion 404. Similarly, in FIG. 9C, a second example electronic tobacco delivery device 450 includes a delivery portion 452 and an electronics portion 454. A user's mouth is formed around a mouthpiece region 418 (468 in FIG. 9C) of the delivery portion 402 (452) of the device 400 (450), as shown in side views 422*a,b* (472*a,b*) and back view 424 (474), to use the device 400 (450). As shown in a front view 420 (470), a control 408 (458) is provided for activating an internal heating element to deliver a smoke or vapor to the end user via an outlet 406 (456) of the mouthpiece region 418 (pipe stem 458), as illustrated in a top view 426 and the back view 424 (474). When inhaling, an inlet 410 (460), shown in a first side view 422*a* (472*a*), allows the introduction of air into the device 400 (450).

The device 400 (450), in some implementations, includes a rechargeable battery for powering the heating element. For example, as illustrated in a bottom view 428 (478), a charging port 412 (462) is provided for recharging an internal rechargeable battery.

Figure 9D:
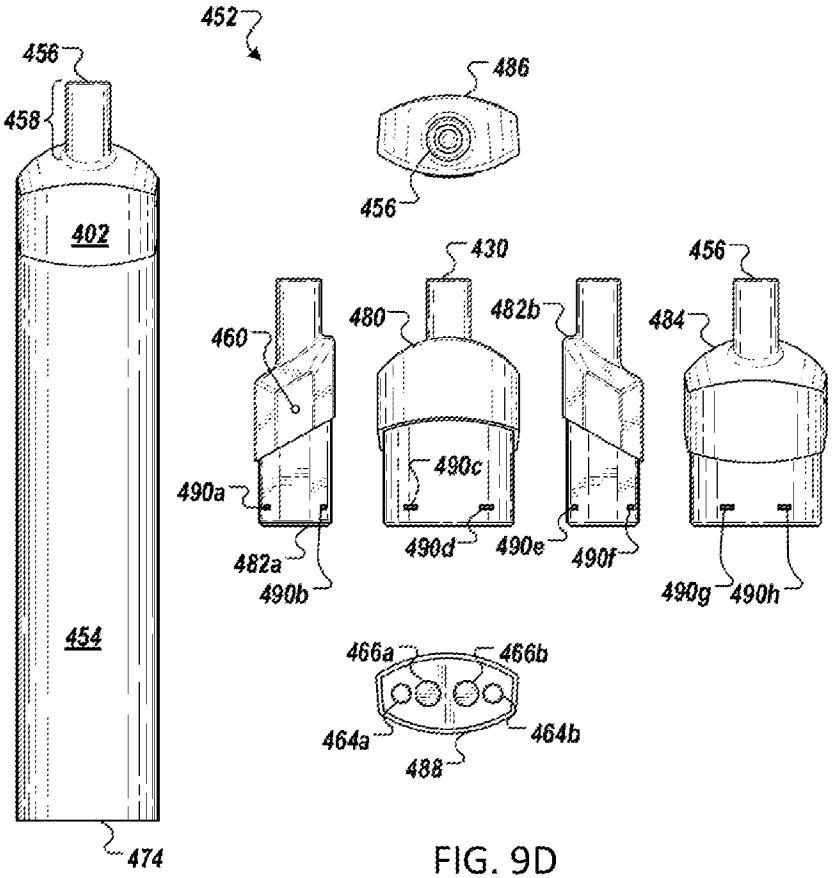
FIG. 9C and FIG. 9D illustrate a second example external design of an electronic tobacco delivery device.
Figure 9C:
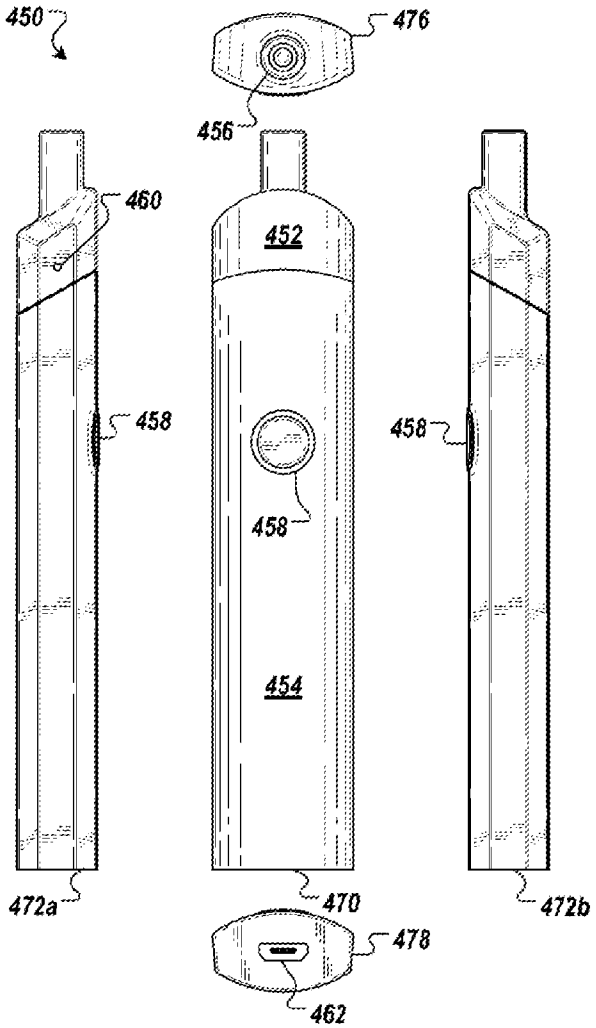

Turning to FIG. 9B-9D, the delivery portion 402 (452) is separated from the electronics portion 404 (454). The delivery portion 402 (452), as shown in a bottom view 438 (488), includes a set of magnets 414*a,b* (464*a,b*) for releasably engaging the electronics portion 404 (454) of the device 400 (450) as well as a set of electrical contacts 416*a,b* (466*a,b*) for receiving electric current from the electronics portion 404 (454) of the device 400 (450). The electrical contacts 416*a,b* (466*a,b*), for example, may be connected to a heating element such as the heating coil 324 of FIGS. 8B and 8C or the heating coil 344 of FIG. 8D. In some embodiments, the delivery portion 402 (452) includes one or more detents or protrusions, such as detents or protrusions 440 (490) illustrated in each of a front view 430 (480), side views 432*a,b*, (482*a,b*) and a back view 434 (484) of FIG. 9B (FIG. 9D). The detents or protrusions 440 (490), for example, may mate with corresponding detents or protrusions on an inner surface of the electronics portion 404 (454) of the device 400 (450).

Figure 4:
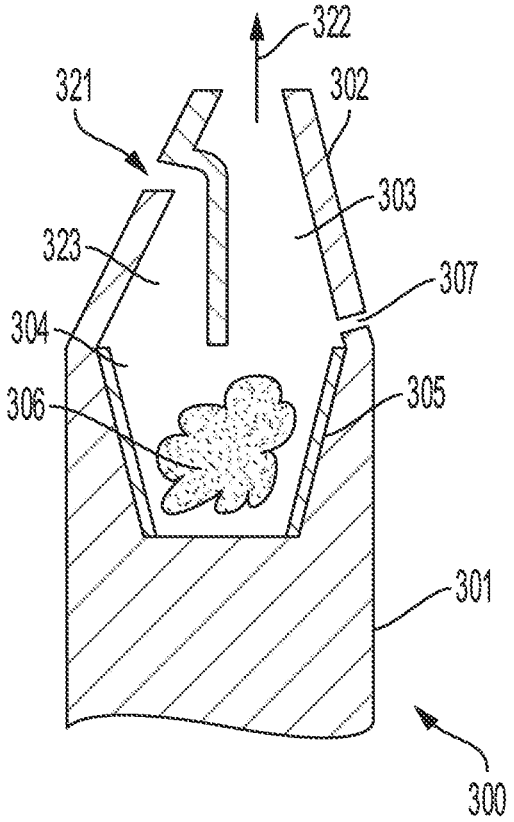
FIG. 4 PRIOR ART
FIG. 4 is an illustration of the conventional PLOOM heat-not-burn device.
Figure 5:
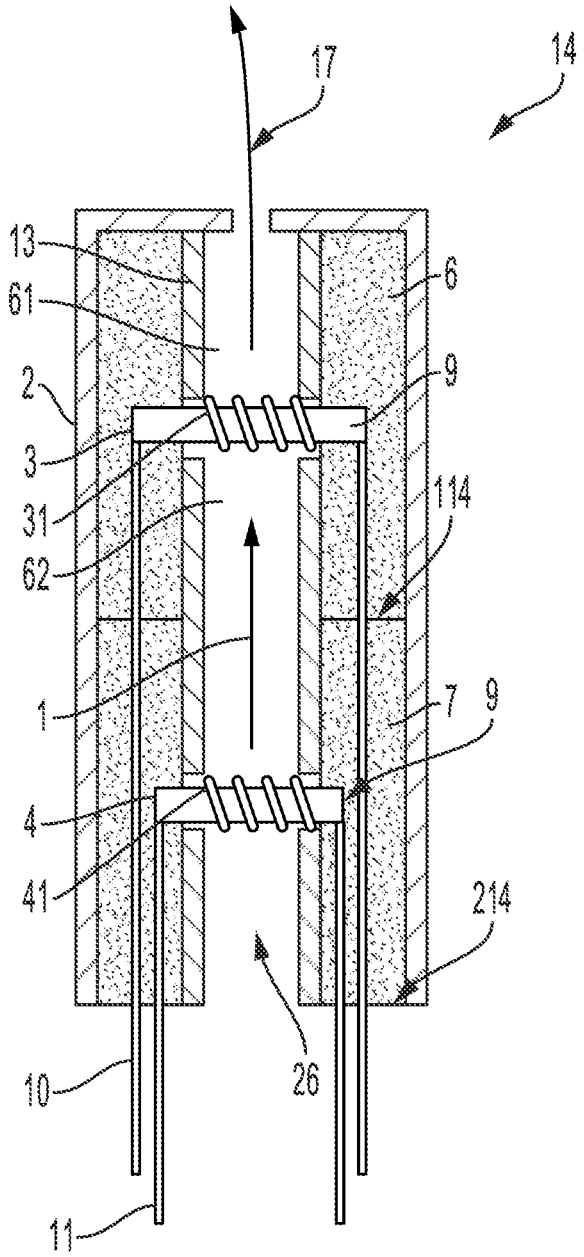
FIG. 5 PRIOR ART
FIG. 5 is an illustration of the conventional JUUL vaping device.

FIGS. 10A through 10E illustrate exploded views of example components for construction of an electronic tobacco delivery device such as the device 300 of FIGS. 8A-8D, the device 400 of FIGS. 4A and 4B, or the device 450 of FIGS. 4C and 4D. Many components are identical across the figures and thus are identically labeled. Having fully described FIG. 8A, only differences between FIG. 8A and the subsequent figure will be discussed hereafter.

Figure 10A:
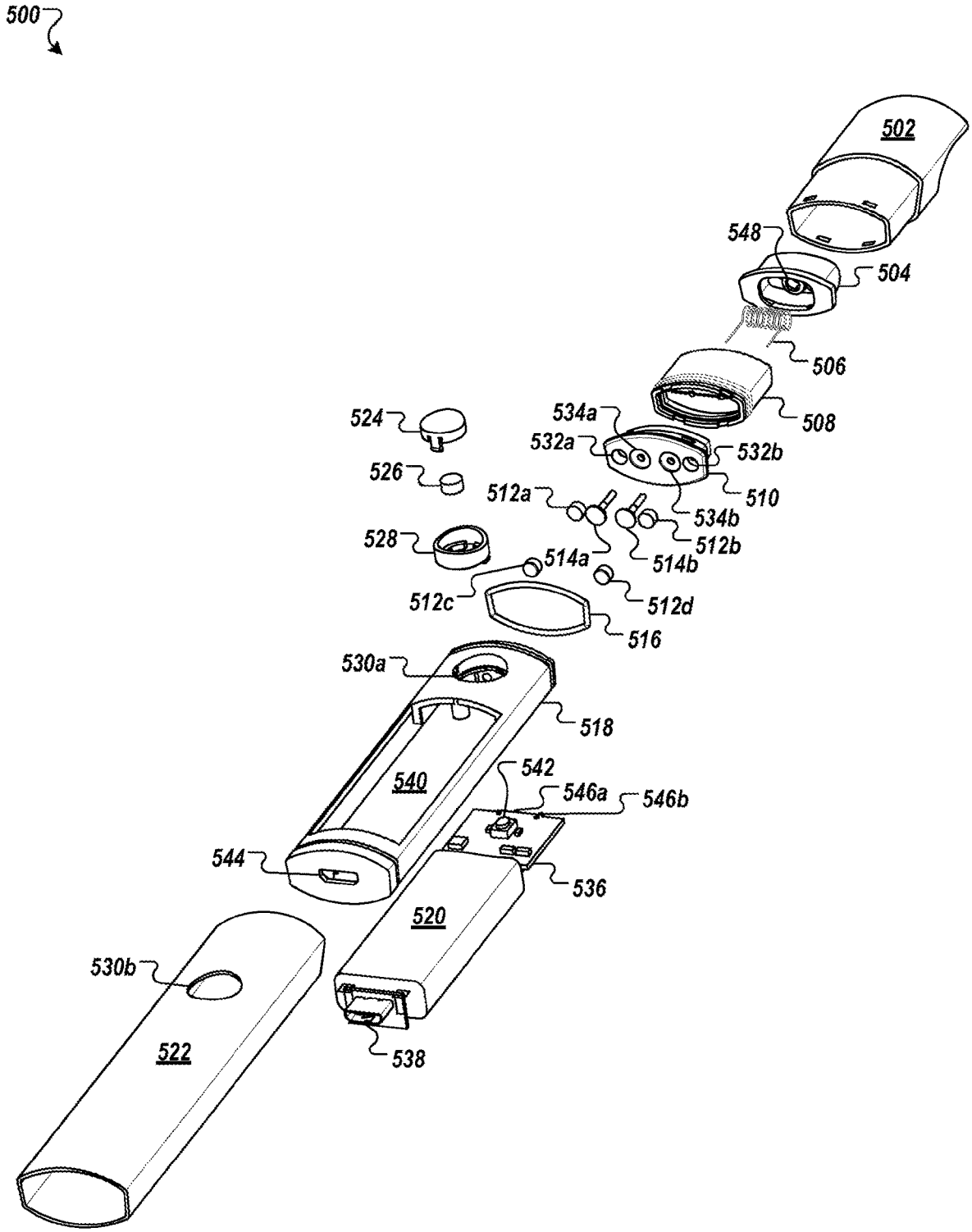
FIGS. 10A-10E illustrate exploded views of the components of example electronic tobacco delivery devices.

Turning to FIG. 10A, an electronic tobacco delivery device 500, in some implementations, includes a mouthpiece 502, a cup cover 504, a heating coil 506, a cup 508, a cup base 510, a set of magnets 512, a set of electrodes 514, an o-ring 516, a battery bracket 518, a battery 520 connected to electronics 536 (e.g., a printed circuit board (PCB)), and an electronics portion exterior body 522. The components 502, 504, 506, 508, 510, 512*a-d*, and 514*a,b*, for example, may be considered to be part of the delivery portion of the device 500, while components 518, 520, and 522 may be considered part of the electronics portion of the device 500. The o-ring 516 may aid in sealing against any leakage of product (e.g., tobacco in liquid suspension) entering the electronics portion of the device 500.

Turning to the mouthpiece portion, in some implementations, the mouthpiece 502 is formed from a generally rigid material, such as a polymer (e.g., plastic). The cup cover 504 is designed to nest in a bottom portion of the mouthpiece 502, with an outlet 548 of the cup cover 504 aligning with a mouthpiece opening (not illustrated). The cup cover 504 may be formed of a flexible or deformable material, such as silicone.

In some implementations, the cup cover 504 partially receives an upper portion of the heating coil 506 which is designed to set within the cup 508. Thus, the cup cover 504 and cup 508 may be formed of a similar or same heat resistant material, such as silicone. The cup cover 504 may be frictionally retained on the cup 508 such that the cup cover 504 may be removed and replaced when refilling the cup 508 with tobacco product.

The cup 508, in some implementations, is designed to connect with the cup base 510. In other implementations, the cup 508 and the cup base 510 are formed from a unitary piece of material. The cup base 510, as illustrated, includes a set of outer openings 532*a,b* for receiving the magnets 512*a,b* as well as a set of inner openings 534*a,b* for receiving the electrodes 514*a,b*. The cup base 510 may be formed of a rigid material, such as plastic. As illustrated, the cup 508 and cup base 510 include corresponding features (e.g., protrusions and detents) for connecting the cup base 510 to the cup 508.

Turning to the electronics portion, in some implementations, the magnets 512*c* and 512*d* are inserted into openings or depressions (not illustrated) in the battery bracket 518. For mating with the magnets 512*a,b* of the delivery portion upon assembly of the device 500. The battery bracket 518 includes an opening 540 to receive the battery 520. In some implementations, electrical contacts 546*a*,546*b* extend from the electronics 536 connected to the battery 520 to physically interface with the electrodes 514*a*,514*b* of the delivery portion upon assembly of the device 500.

In some implementations, a charging connector 538 connected to the battery 520 is designed for insertion through a charging connector opening 544 in the battery bracket 518. The charging connector 538, for example, may be a universal serial bus (USB) style charging connector, such as a mini-USB, micro-USB, or USB-C connector for interfacing with a corresponding USB charging port.

In some implementations, after inserting the battery 520 into the battery bracket 518, an activation control 542 of the electronics 536 is arranged beneath an opening 530*a* of the battery bracket 518. The activation control 542 may be activated through actuation of a button situated over the activation control 542. As illustrated, a button 524, button pad 526, and button guide 528 may be installed within the opening 530*a* above the activation control 542. Each of the button 524, button pad 526, and button guide 528 may be composed of a polymer, such as a plastic. To activate the device 500, the user may press and hold the button 524.

The battery bracket 518, in some implementations, is covered by an electronics portion exterior body 522. The exterior body 522 includes a corresponding opening 530*b* to the opening 530*a* in the battery bracket 518 to provide external access to the button 524. The exterior body 522, in some embodiments, is composed of a polymer material, such as plastic. In other embodiments, the exterior body 522 is composed of a metal, such as aluminum. In further embodiments, the exterior body 522 is composed of natural material, such as wood or bamboo. The exterior body 522 may include a decorative design.

Figure 10B:
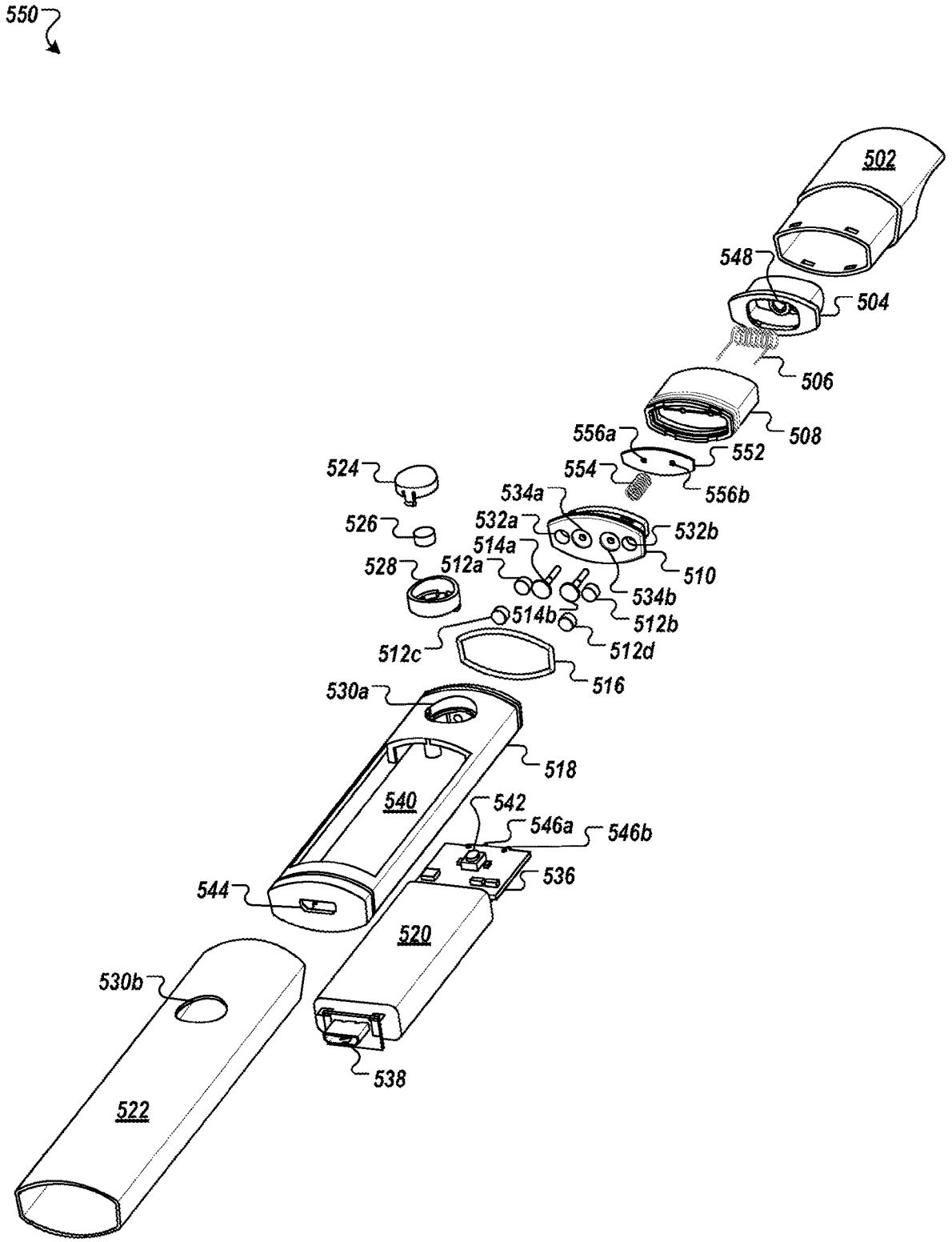
Figure 10C:
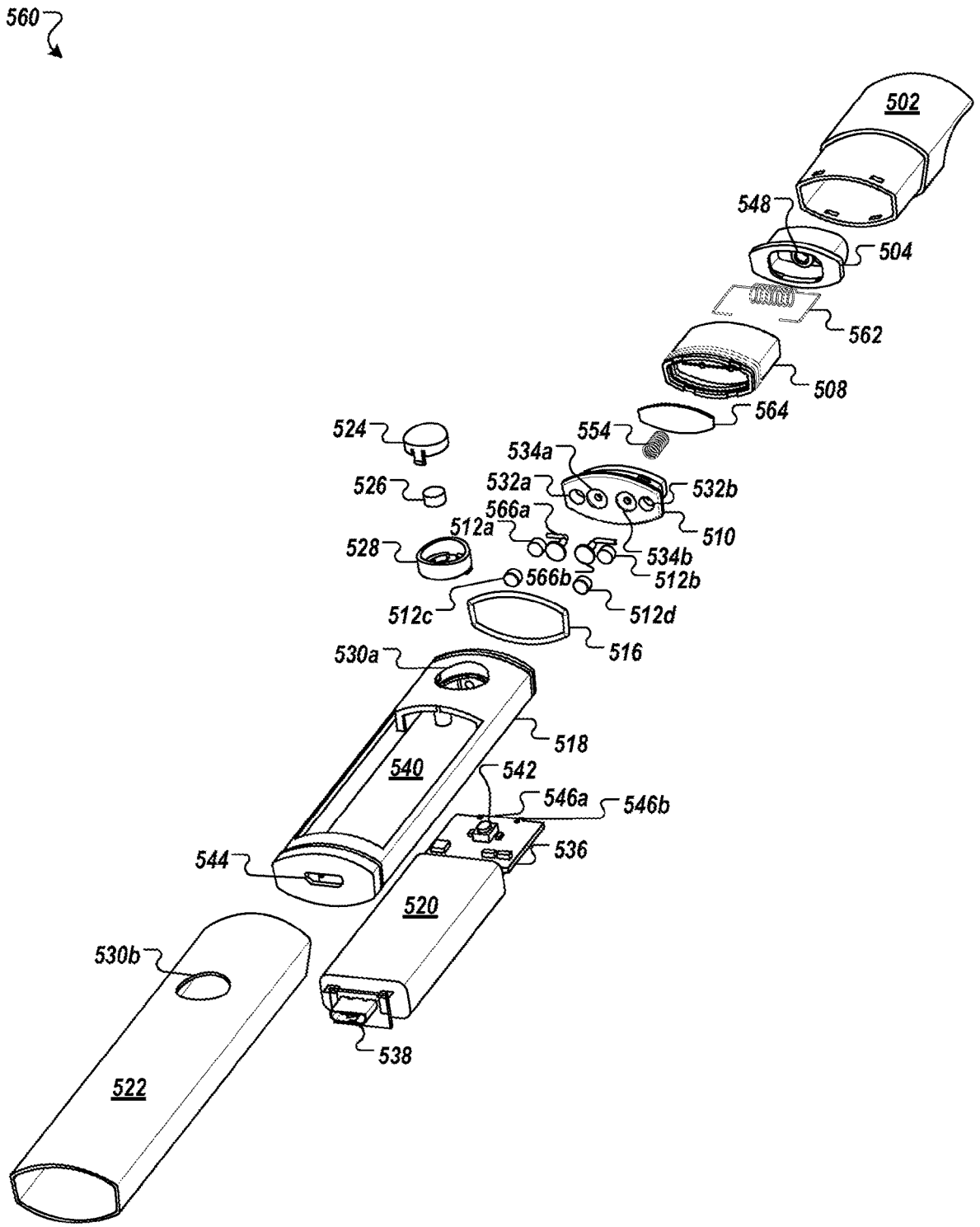

Turning to FIG. 10B, in a second example device 550, in some implementations, a movable floor 552 and advancement spring 554 are positioned between the cup cover 504 and the cup base 510 to urge tobacco product toward the heating element 506 while the tobacco product is evaporated and/or burned during use. Initially, for example, the advancement spring 554 may be fully compressed, with the movable floor 552 positioned as close to the cup base 510 as possible. Further to this example, tobacco product may fill the cup 508 from the movable floor 552 to the cup cover 504, at least partially covering the coils of the heating element 506. As the device 550 is used and the tobacco product diminishes, the force of the spring 554 exceeds the force of the weight of the tobacco product or otherwise urges the tobacco product toward the "ceiling" of the cup enclosure (316 in FIG. 8B). The moveable floor 552 is pushed upward toward the coils of the heating element 506, moving the tobacco product closer to the coils of the heating element 506 and thereby encouraging consistent heating of tobacco product within the cup 508 and more complete consumption of the tobacco product (which may otherwise adhere to the walls of the cup 508).

In some embodiments, the movable floor 552 is composed of a rigid material, such as a plastic. The movable floor 552 may be composed of a rigid silicone, for example, for improved heat resistance. In other embodiments, the movable floor 552 is composed of a heat conducting material to improve heating of the tobacco product from a lower region of the cup 508. For example, the movable floor 552 may be composed of a metal such as aluminum.

The movable floor 552 includes a deformable edge or o-ring, in some embodiments, to resist leakage of the tobacco product. Further, the openings 556*a*,556*b* of the movable floor 552 may include a deformable edge or o-ring to resist leakage along the ends of the heating element 506.

To assemble the device 550, in some implementations, the ends of the heating element 506 are inserted through openings 556*a*, 556*b* in the movable floor 552 and into the stems of the electrodes 514*a*, 514*b*. In other implementations, turning to FIG. 10C, rather than the heating element 506 extending through the openings 556*a*, 556*b* of the movable floor 552 to connect with electrodes 514*a,b*, a wrap-around heating element 562 may be provided to extend around the edges of a movable floor 564 and connect into a set of L-shaped stems of electrodes 566*a*, 566*b*

Figure 10D:
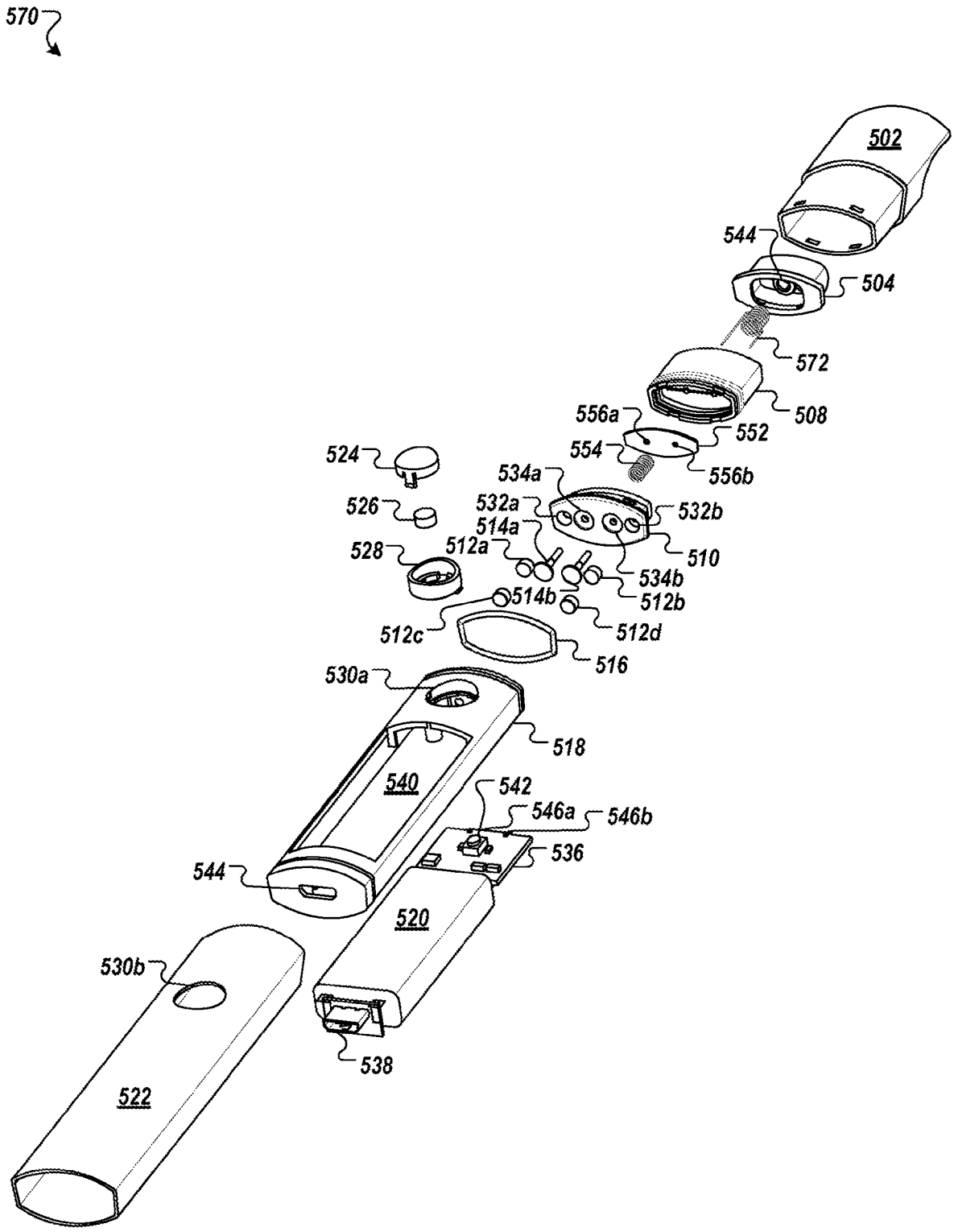

In some implementations, rather than a horizontally positioned heating coil, the heating coil may be vertically oriented. Turning to FIG. 10D, for example, an example electronic tobacco delivery device 570 includes a vertical heating coil 572 provided between the cup cover 504 and the cup base 510. The ends of the heating coil 572, as illustrated, are designed to be assembled through the openings 556*a*, 556*b* of the movable floor 552 and into the electrodes 514*a,b*. In other embodiments (not illustrated), the movable floor 552 and spring element 554 may be removed. The vertical heating coil 572, for example, may be positioned to heat a greater surface area of the suspension mixture in the cup 508 without need for urging the suspension mixture toward the heating coil 572. In illustration, the vertical heating coil 572 may replace the heating coil 506 in the electronic tobacco delivery device 500 of FIG. 10A.

Figure 10E:
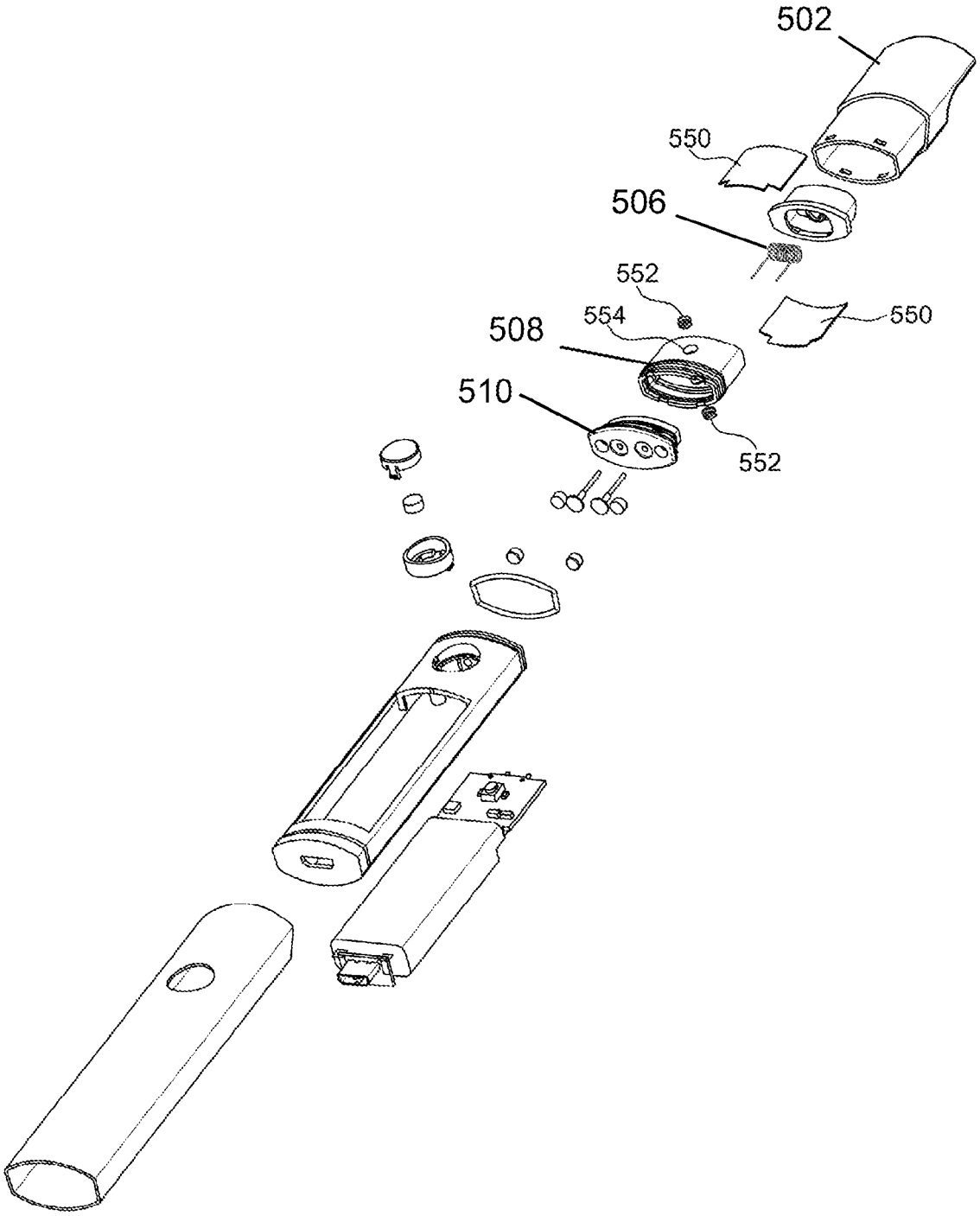

In some implementations, rather than a moveable floor applying spring-loaded pressure to move the tobacco product closer to the coils of the heating element as depicted in FIG. 10B, moveable walls or spring-loaded push boards may be used to apply lateral pressure to the tobacco product or otherwise urge the tobacco product toward the heating element. Having fully described FIG. 10B, only differences between FIG. 10B and FIG. 10E will be discussed hereafter. Turning to FIG. 10E, for example, lateral push boards 550 are positioned within cup 508 along the walls of the cup that include apertures 554. The springs 552 are positioned within apertures 554 and, when base unit 510 and cup 508 are installed within mouthpiece 502, the springs are compressed between the wall of mouthpiece 502 and push boards 550. The springs 552 urge each push board 550 toward the heating element 506. After being loaded with tobacco product, for example, the advancement springs 552 may be in a fully compressed position and the push boards 550 may be in contact with the interior walls of cup, effectively covering and closing apertures 554. As the device 580 is used and the tobacco product is consumed, the force of springs 552 apply pressure to the push boards and urge the remaining tobacco product into contact with the heating element. In some implementations, the push boards 550 are formed from a generally rigid material, such as a heat resistant polymer or metal.

FIGS. 11A and 11B illustrate example cup designs and corresponding cap designs for holding a suspension mixture including tobacco or other plant substance mixed with a suspension liquid. The cup and cap designs, for example, may be used in an electronic tobacco delivery device such as the device 300 of FIG. 8A, the device 400 of FIG. 9A, or the device 450 of FIG. 9C. Turning to FIG. 11A, a cup 600 is illustrated with corresponding cap 610. The cup 600, for example, may correspond to the cup 508 of FIGS. 10A-10E, while the cap 610 may correspond to the cup cover 504 of FIGS. 10A-10D. The cup 600, for example, may be designed to mate with a cup base that includes electrode connections for supplying electrical current to a heating element, such as the cup base 510 of FIGS. 10A-10E. The cup 600, for example, includes notches 602 for mating with corresponding notches in a cup base. The cup 600 is shaped to be wider at a central region and narrower along the edges, for example, to provide for greater volume of the suspension mixture surrounding the heating element (not illustrated) centrally located within an interior 606 of the cup 600.

The cup 600, in some implementations, includes one or more raised members 604 (e.g., ridges) encircling the exterior of the cup 600. The raised members 604 may provide a seal between the cup wall that the adjacent surface of the disposable mouthpiece unit 302, 402, 502. The cups described herein are preferably provided with a bottom surface or floor such that the cups are able to contain liquid secreted from the tobacco product without relying on a seal that is formed between the cup wall and base. In such embodiments, small apertures are provided in the cup floor to allow the wires of the heating element to extend therethrough in a watertight fashion.

In some implementations, the upper rim of cup 600 mates with the cap 610 to retain the suspension mixture within the interior 606 of the cup 600. The cap 610 includes an outlet 612 (e.g., such as the outlet 548 of the cup cover 504 of FIGS. 10A-C) to direct smoke or vapor from heating the suspension mixture to a mouthpiece of the electronic tobacco delivery device. The outlet 612, in some embodiments, includes a raised surface 616 that may mate with an outlet of the mouthpiece (not illustrated) of the electronic tobacco delivery device. Further, in some embodiments, the cap 610 includes an inlet 614 for directing air flow into the cup interior 606.

Turning to FIG. 11B, a cup 620 is illustrated with corresponding cap 630. The cup 620 may be designed to mate with a cup base including electrode connections for supplying electrical current to a heating element, such as the cup base 510 of FIGS. 10A-10E. The cup 620, for example, may include notches such as a notch 622 for mating with corresponding notches in a cup base.

The cup 620, in some implementations, includes one or more raised members 624 (e.g., ridges) encircling the exterior of the cup 620. The raised members 624, for example, may provide a seal against the adjacent surface of the mouthpiece housing 302, 402, 502.

In some implementations, the cup 620 mates with the cap 630 to retain the suspension mixture within the interior 626 of the cup 620. The cap 630 includes an outlet 632 (e.g., such as the outlet 548 of the cup cover 504 of FIGS. 10A-10C) to direct smoke or vapor from heating the suspension mixture to a mouthpiece of the electronic tobacco delivery device. The outlet 632, in some embodiments, includes a raised surface 636 that may mate with an outlet of the mouthpiece (not illustrated) of the electronic tobacco delivery device. Further, in some embodiments, the cap 630 includes an inlet 634 for directing air flow into the cup interior 626.

Figure 12:
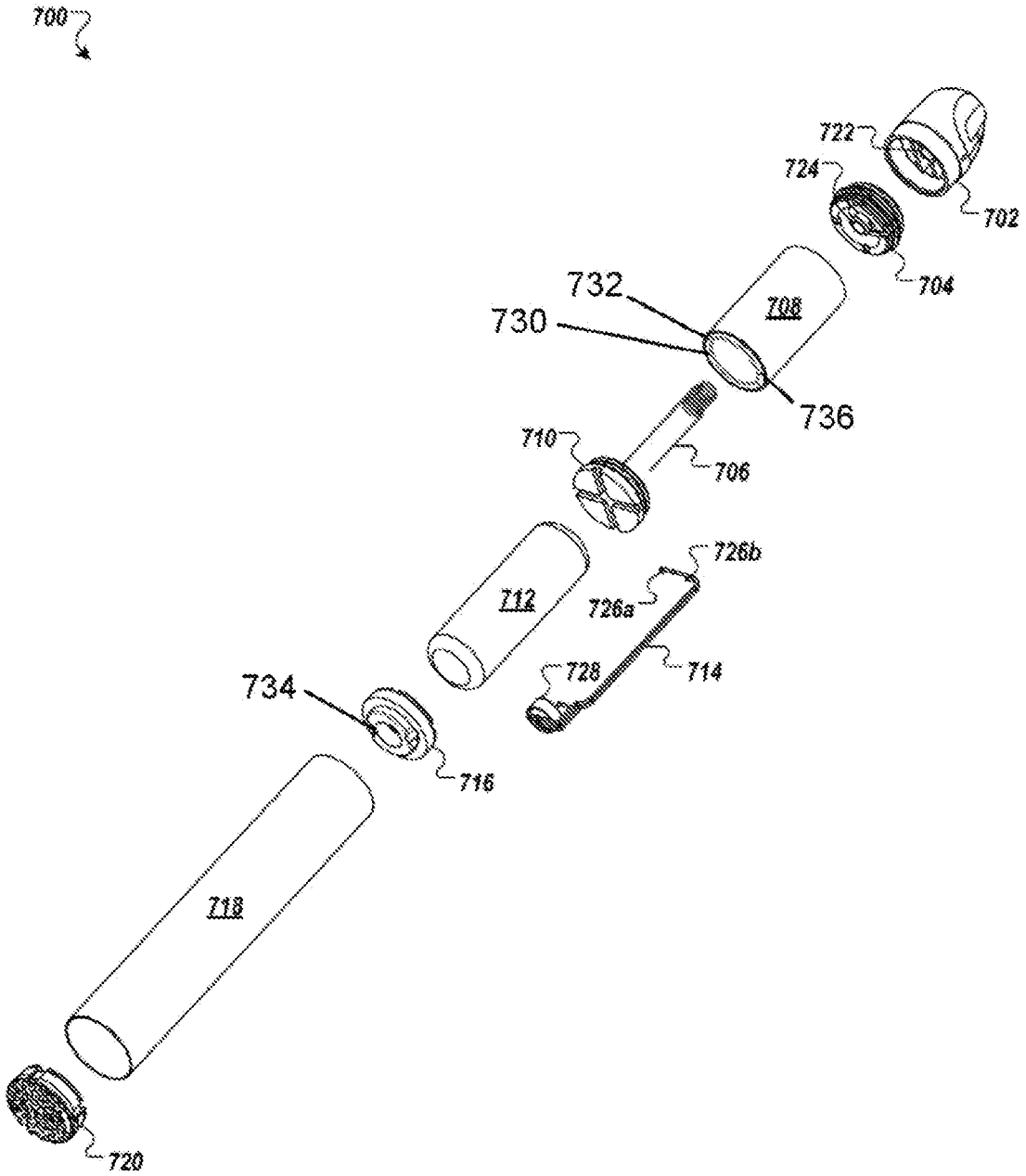
FIG. 12 illustrates an exploded view of the components of another example electronic tobacco delivery device.

FIG. 12 illustrates an exploded view of example components of an electronic tobacco delivery device 700 having a battery 712. The electronic tobacco delivery device 700, in some implementations, includes a mouthpiece 702, a cup cover 704, a heating coil 706, a housing 708, a housing base 710, a battery 712 connectable to conductor elements or harness 714, a base 716, a housing 718, chip 728 and an exterior tip 720. The electronic tobacco delivery device 700, for example, may be disposed after use and may be enclosed with an outer housing or cover such that device 700 has an overall appearance similar to a cigarette. In this implementation, the entire device 700 is disposable.

In other implementations, a portion of the tobacco delivery device 700 may serve as a rechargeable and reusable body portion. For instance, the portion of tobacco delivery device 700 comprising elements 720, 718, 716, 712, 726*a*, 726*b*, 714, and 728 may comprise a reusable base unit similar in principle to body portion 304 described above and the remaining components may combine to form a disposable mouthpiece unit similar in principle to delivery unit 302 described above. In such embodiments, the reusable base unit and disposable mouthpiece or delivery unit may be connectable and detachable by a user via the means discussed above including, for example, magnetic means. The reusable base unit of tobacco delivery device 700 may be recharged by the user by connecting to, for example, a universal serial bus (USB) style charging connector, such as a mini-USB, micro-USB, or USB-C connector for interfacing with a corresponding USB charging port. Alternatively, the device 700 may be configured with a removable cap element (not shown) to permit removal and reinstallation of a traditional battery, such as a AAA battery.

The disposable mouthpiece unit of tobacco delivery device 700 may comprise elements 710, 706, 708, 704, 702, 722, and 724. The disposable mouthpiece unit may be attached to the reusable electronics or base unit via a magnetic coupling that cooperates with mating collar elements on the two units that ensure that the units are held together securely enough to remain intact during normal use.

The structure and operation of device 700 will now be described in more detail. The mouthpiece 702 is formed from a generally rigid material, such as a polymer. The cup cover 704 is configured for insertion into a bottom portion of the mouthpiece 702, with an outlet 724 of the cup cover 704 aligning with a mouthpiece opening 722. Current is provided to the heating element 706 by battery 712 through contacts 726*a,b*. The application of current from the battery to the heating element is controlled by chip 728 through connector harness 714. In some implementations, there may be a void or space that is occupied by air at the distal end of device 700, near tip 720. Cylindrical housing 718 is connected to base 710 at the proximal end of the housing 718, optionally in a releasable manner described above.

In some implementations, there are openings or grooves in tip 720 through which air is drawn by inhalation by the user. Drawn by negative pressure applied to mouthpiece 702, this air passes through apertures 734 in element 716 and then along a gap between the interior walls of cylindrical housing 718 and the battery 712. The air flows through the grooves in the bottom of base 710 and to the proximal side of base unit through apertures or grooves (not shown). The air then flows then along four channels 736 each formed by the housing 708, the outer surface of deformable cup 730, and rib members 732 of the deformable cup 730. The air then flows through the grooves in the bottom of cover 704 and across the top of the heating element 706. The aerosolization of the tobacco product loaded into cup 730 occurs in substantially the same manner described in detail above. The air and aerosolized tobacco product passes through apertures 724 and 722 and into the mouth of the user.

Optionally base 716 may be equipped with an LED that illuminates when triggered by a pressure sensor (not shown) disposed within cup 708 or mouthpiece 702. Optionally body 718 may be equipped with an LED that illuminates when inhalation by the user generates negative pressure within the device. The pressure sensor may be conveniently located on element 716, proximate control circuit element 783. In some implementations, light from an LED within base 716 is transmitted through cylindrical body 718 to an optionally transparent or translucent cap 720. In this manner, during inhalation, the end cap 720 may glow red with the light emitted by the LED to simulate a traditional cigarette.

Figure 13:
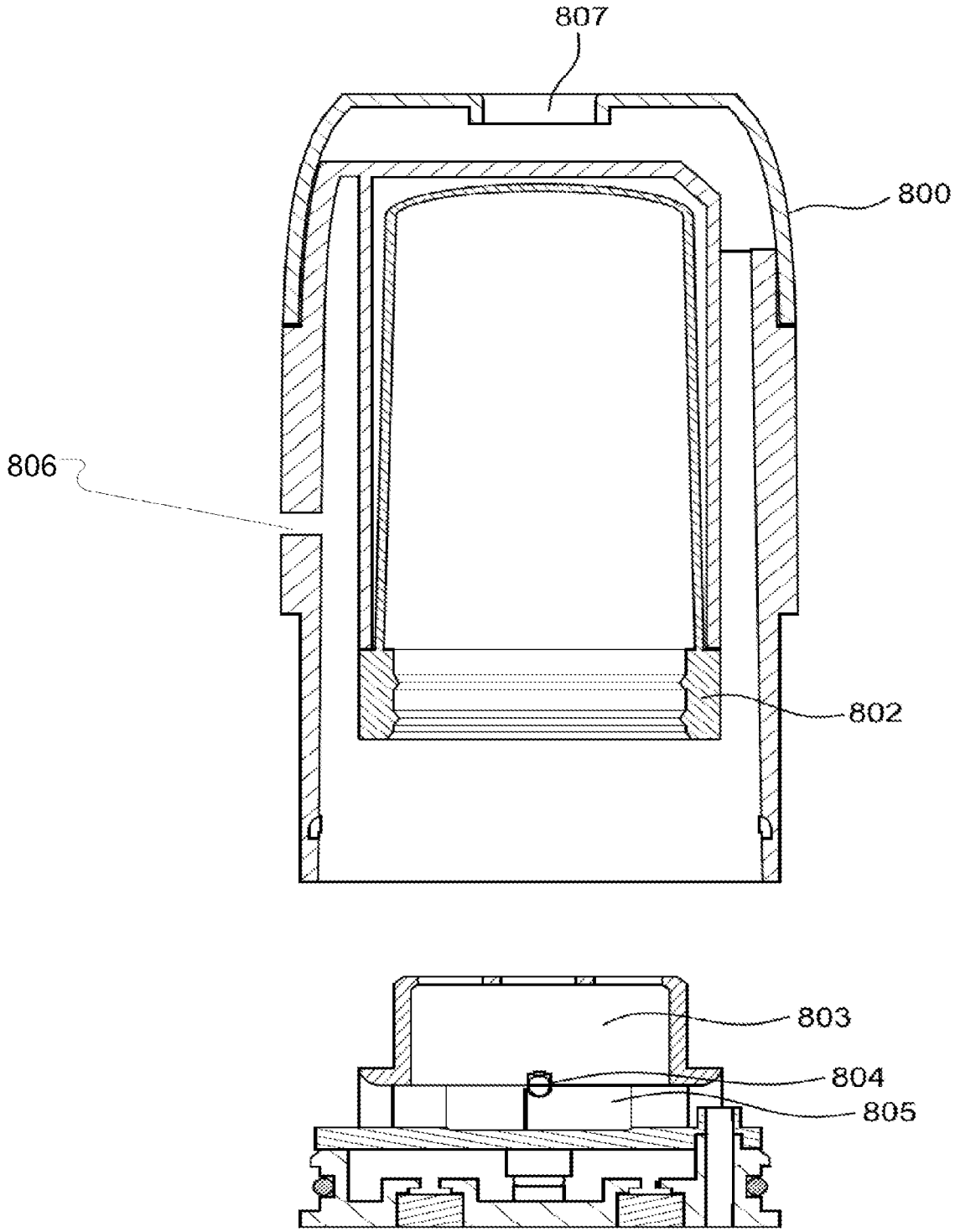
FIG. 13 illustrates an exploded view of the components of yet another example electronic tobacco delivery device.

FIG. 13 illustrates yet another disposable mouthpiece unit for use in a portable electronic tobacco delivery device. Disposable mouthpiece unit 800, in some implementations, comprises flexible cup element 802, porous filter elements 803, heating element 804, flow channel 805, aperture 806, and aperture 807. The depicted lower assembly comprising elements 803, 804, and 805 is inserted into the upper assembly comprising elements 802, 806, and 807 such that the enclosure surrounding filter 803 seals against the inwardly projecting ribs of cup 802. Flexible cup element 802 may be filled with tobacco product e.g., a suspension mixture including tobacco or other plant substance mixed with a suspension liquid, as described above.

Upon application of negative pressure to aperture 807 by inhalation by the user, air is drawn into device 800 through aperture 806, passing through channel 805. Concurrent with inhalation by the user, electricity is delivered to heating element 804 as described above. The negative pressure within the device generated by inhalation by the user draws liquid out of the tobacco product contained within flexible cup element 802 and into porous filter element 803 and into intimate contact with heating element 804. The liquid bears volatile compounds derived from the tobacco product, which may be aerosolized when heated by contact with heating element 804 and carried through channel 805 and aperture 807 to the mouth of the user.

In this embodiment, the solid tobacco product is not brought into contact with the heating element, but rather only the liquid component of the tobacco product mixture. This liquid component saturates the filter element 803 and surrounds the heating element. As described below, in certain experiments this design smothered the heating element and prevented effective aerosolization of the liquid portion of the tobacco product.

Figure 14:
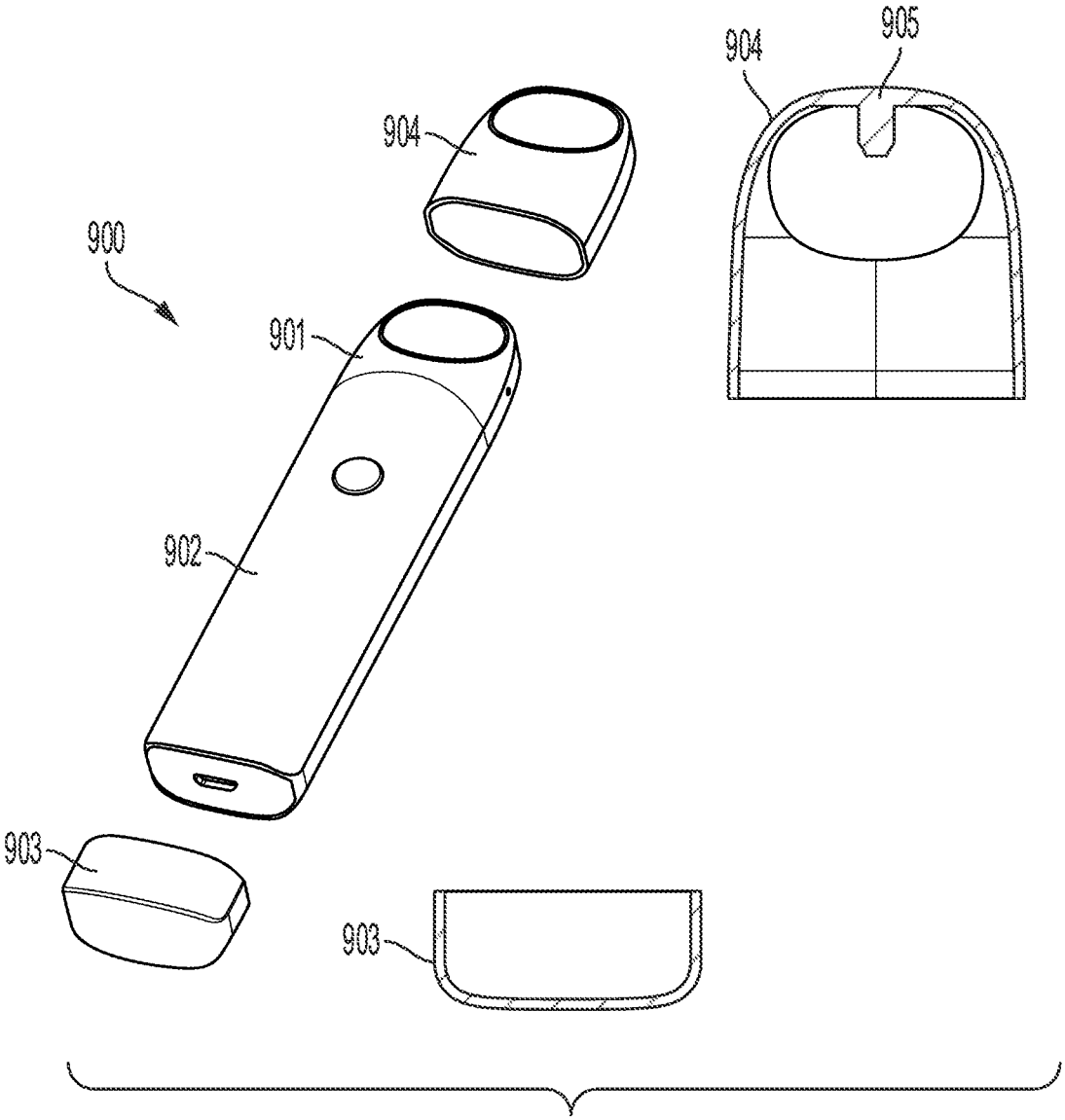
FIG. 14 illustrates an exploded view of capping elements for use with an example electronic tobacco delivery device.

FIG. 14 depicts a tobacco delivery device 900 substantially as shown and described above in connection with FIGS. 8A-8D. The delivery device 900 includes a disposable mouthpiece unit 901, a reusable body unit 802, a top cap 904 and a bottom cap 903. The cap 904 may be constructed of a flexible polymeric material and include a plug element that is configured to seal the inhalation port 328 in the mouthpiece 904. This may prevent a liquid portion of the tobacco product from exiting through that port when, for instance, the device 900 is carried in a pocket in an inverted orientation. The cap 903 may protect the electrical charging components at the distal end of the body portion 902. Each of the disposable mouthpiece units 901 may be equipped with a cap 904 at the time of manufacture to prevent leakage of the liquid portion of the tobacco product during shipment and storage. The cap 904 may advantageously also cover and optionally provide a plug (not shown) for the inlet 330. Provision of this plug has the additional benefit of holding the cap 904 in place and preventing it from sliding off mouthpiece unit 901 in an unintended manner.

Certain teachings herein may be adaptable to substances other than tobacco, which have similar properties such as being plant based, having leaves capable of being processed in the manner described herein and used in combination with a portable electronic delivery system.

As various changes may be made in the above-described subject matter without departing from the scope and the spirit of the invention, it is intended that all subject matter contained in the above description, or shown in the accompanying drawings, will be interpreted as descriptive and illustrative, and not in a limiting sense.

EXAMPLES

Comparative Example 1

Organic pasteurized tobacco leaves were heated at a pressure of 5-20 atmospheres in the presence of distilled, purified or tap water at a temperature of 85° C.-100° C. for a duration of 5-60 minutes optionally with low speed mixing (10-100 rpm). Thereafter the tobacco product was removed from the water bath dried, optionally under radiant heat for one hour. The product was then cut or ground into strips or pieces having a largest dimension of 50 to 2,000 microns, or more preferably 100 to 1,000 microns. The cut or ground tobacco and/or herb product was combined with the water in which the tobacco and/or herb product was mixed ground tobacco product about 1:1 by weight with glycerin and allowed to sit for one hour. The viscosity of the resulting tobacco product was approximately 20,000 to 40,000 cp.

2 to 2.5 g of wet tobacco product was placed in cup 802 of the device 800 of FIG. 13. A filter 803 was positioned between the tobacco product and the heating element 804. Air was drawn in through inlet 806 and across filter element through channel 805. Air was exhausted and inhaled through port 807. Otherwise the device operated in a manner similar to that described above.

The device yielded 0-5 puffs, after which the device ceased to produce additional puffs from the dose of the tobacco product.

Example 2

Organic pasteurized tobacco leaves were heated at a pressure of 5-20 atmospheres in the presence of distilled, purified or tap water at a temperature of 85-100° C. for a duration of 5-60 minutes optionally with low speed mixing (10-100 rpm). Thereafter the tobacco product was removed from the water bath dried, optionally under radiant heat for one hour. The product was then cut or ground into strips or pieces having a largest dimension of 50 to 2,000 microns, or more preferably 100 to 1,000 microns. The cut or ground tobacco and/or herb product was combined with the water in which the tobacco and/or herb product was mixed ground tobacco product about 1:1 by weight with glycerin and allowed to sit for one hour. The viscosity of the resulting tobacco product was approximately 20,000 to 40,000 cp.

2 to 2.5 g of wet tobacco product was placed in cup 312 of the device 300 of FIGS. 8A-8D. The device was operated in the manner described above in connection with that embodiment.

The device yielded 20-30 puffs of rich, aerosolized vapor that simulated the taste and user experience associated with smoking a traditional tobacco product.

Example 3

Organic pasteurized tobacco leaves were heated at a pressure of 5-20 atmospheres in the presence of distilled, purified or tap water at a temperature of 85-100° C. for a duration of 5-60 minutes optionally with low speed mixing (10-100 rpm). Thereafter the tobacco product was removed from the water bath dried, optionally under radiant heat for one hour. The product was then cut or ground into strips or pieces having a largest dimension of 50 to 2,000 microns, or more preferably 100 to 1,000 microns. The cut or ground tobacco and/or herb product was combined with the water in which the tobacco and/or herb product was mixed ground tobacco product about 1:1 by weight with glycerin and allowed to sit for one hour. The viscosity of the resulting tobacco product was approximately 20,000 to 40,000 cp.

2.3 g of wet tobacco product was placed in cup of the device 400 of FIGS. 9A-9D. The device was operated in the manner described above in connection with that embodiment.

The device yielded 235 puffs of rich, aerosolized vapor that simulated the taste and user experience associated with smoking a traditional tobacco product. That is greater than an order of magnitude more puffs per pod or dose than provided by IQOS or a regular cigarette (10-14 puffs).

This system generated about 100 puffs per gram of tobacco product, substantially higher than IQOS, which produces about 30-47 puffs per gram of tobacco product (10-14 puffs for 0.3 grams of tobacco product per Heatstick).

Example 4

Organic pasteurized tobacco leaves are heated at a pressure of 5-20 atmospheres in the presence of distilled, purified or tap water at a temperature of 85-100° C. for a duration of 5-60 minutes optionally with low speed mixing (10-100 rpm). Thereafter the tobacco product is removed from the water bath dried, optionally under radiant heat for one hour. The product is then cut or ground into strips or pieces having a largest dimension of 50 to 2,000 microns, or more preferably 100 to 1,000 microns. The cut or ground tobacco and/or herb product is combined with the water in which the tobacco and/or herb product was mixed ground tobacco product about 1:1 by weight with glycerin and allowed to sit for one hour. The viscosity of the resulting tobacco product is approximately 20,000 to 40,000 cp.

1.3 g of wet tobacco product was placed in cup of the device 500 of FIGS. 10A-10E. The device was operated in the manner described above in connection with that embodiment.

The device yielded 155 puffs of rich, aerosolized vapor that simulated the taste and user experience associated with smoking a traditional tobacco product. That is about an order of magnitude more puffs per dose than provide by IQOS or a regular cigarette (10-14 puffs).

This system generated about 120 puffs per gram of tobacco product, substantially higher than IQOS, which produces about 30-47 puffs per gram of tobacco product (10-14 puffs for 0.3 grams of tobacco product per Heatstick).

Example 5

A smoke test was performed with twenty-one participants, none of whom was aware of any affiliation between the test administrator and any device. The participants were asked to use both the IQOS device and the device of Example 4. Each participant puffed the devices for at least 10-14 puffs each, which in the case of the IQOS product consumed the entire Heatstick. The participants were asked to rate each product on a scale of 1 to 5, 1 being worst or most negative and 5 being best or most positive. The results are presented below and are consistent with those observed in each of several previous smoke tests conducted by independent third parties.

TABLE 3

| Partici- | Do you like the taste? | | Would you use this product? | | Ease of Use | |
|---|---|---|---|---|---|---|
| pant | IQOS | Example 4 | IQOS | Example 4 | IQOS | Example 4 |
| 1 | 1 | 4 | 1 | 4 | 1 | 4 |
| 2 | 1 | 4 | 1 | 4 | 1 | 5 |
| 3 | 2 | 5 | 2 | 4 | 2 | 5 |
| 4 | 1 | 4 | 1 | 4 | 1 | 5 |
| 5 | 1 | 5 | 1 | 5 | 1 | 5 |
| 6 | 1 | 5 | 1 | 5 | 1 | 5 |
| 7 | 1 | 4 | 1 | 5 | 1 | 5 |
| 8 | 1 | 4 | 1 | 5 | 1 | 5 |
| 9 | 1 | 5 | 1 | 5 | 1 | 5 |
| 10 | 1 | 5 | 1 | 4 | 1 | 5 |
| 11 | 2 | 4 | 1 | 3 | 1 | 5 |
| 12 | 1 | 5 | 1 | 5 | 1 | 5 |
| 13 | 2 | 5 | 1 | 4 | 1 | 5 |
| 14 | 2 | 5 | 1 | 5 | 1 | 5 |
| 15 | 1 | 5 | 1 | 4 | 1 | 5 |
| 16 | 2 | 5 | 1 | 4 | 1 | 5 |
| 17 | 1 | 5 | 1 | 4 | 1 | 5 |
| 18 | 1 | 5 | 1 | 4 | 1 | 5 |
| 19 | 2 | 3 | 1 | 4 | 1 | 5 |
| 20 | 1 | 5 | 1 | 5 | 1 | 5 |
| 21 | 1 | 4 | 1 | 5 | 1 | 5 |
| Average | 1.29 | 4.57 | 1.05 | 4.38 | 1.05 | 4.95 |

The data shows that the product of Example 4 was deemed to provide far improved taste and ease of use. As to taste, on a scale of 1 to 5 (5 being best) IQOS received a rating of 1.29 (1 being worst) and the product of Example 4 was given a rating of 4.57 (5 being best). For ease of use, IQOS received a rating of 1.05 compared to 4.95 for the embodiment of Example 4.

The tobacco product of Example 4 is aerosolized at comparatively low temperature, on the order of 75-125° C., which reduces HPHCs four to six times or more relative to conventional heat-not-burn products such as IQOS. A reduction of 4, 5 or 6 times would be achieved even if the product of Example 4 used a tobacco product containing the same array of synthetic ingredients added to the IQOS Heatstick. However, product of Example 4 uses a simple, organic recipe consisting of just three ingredients: about 65-75% glycerin, about 5-15% water, and about 20% organic tobacco. The product of Example 4 thus produces fewer products of unknown toxicity as compared to IQOS. Those products yield acetals that are typically produced when the flavorants and propylene glycol, both of which are present in IQOS Heatsticks, are heated while in the same mixture. The overall reduction of harmful effluents is reduced 7, 8, 9 or 10 times relative to IQOS.

The product of Example 4 is also substantially less complicated and expensive to manufacture than IQOS and other conventional heat-not-burn products. Manufacturing an IQOS Heatstick is a multi-step process that involves an expensive and relatively large manufacturing facility. By contrast, the process of preparing the composition of the exemplified embodiments merely involves the high-pressure heating of tobacco product followed by drying, grinding and combining the ground tobacco product about 1:1 by weight with glycerin, after which the tobacco product is added to the pod.

In another aspect, the products exemplified herein are believed to be the first to achieve acceptable aerosolization and taste without propylene glycol or an auxiliary moisture water or vapor source. As discussed above, conventional heat-not-burn products that use real tobacco rely upon propylene glycol or an additional source of water vapor to provide an enhanced user taste and experience. The product of Example 4, for example, avoids the adverse effects of propylene glycol such as the formation of acetals in the presence of common flavorants and the complexity and expense of providing an auxiliary source of water vapor.

Yet another advantage of certain of the embodiments exemplified herein is that the tobacco product contained in the disposable mouthpiece unit may be aerosolized or "consumed" over a number of smoking sessions separated by hours or even days. As noted above, conventional heat-not-burn tobacco products provide mini-cigarettes such as IQOS and GLO must be used in one sitting or smoking session, potentially because the dry tobacco product is carbonized after heating and not thereafter suitable for reheating in another smoking session. The embodiments exemplified herein advantageously need not be consumed all in one smoking session, potentially because the wet tobacco product composition and the dual mechanism of action substantially prevent carbonization of the wet tobacco product. In various embodiments, a user may consume a single disposable unit or pod over 1, 2, 3, 4, 5, 6, 7, 8, 9, 10, 11, 12, 13, 14, 15, 16, 17, 18, 19, or 20 smoking sessions each separated by at least 10, 20, 30, 60, 90, 180, 360, or 720 minutes or values therebetween. A user of the exemplified embodiments thus may use a single disposable unit over, for instance, around ten smoking sessions spaced over many hours or even days.

In yet another aspect, in contrast to conventional vaping products, the aerosolized product is real tobacco and contains no added nicotine. That avoids the increased risk of addiction and short-term health effects reported in connection with modern vaping devices.

The forgoing general description of the illustrative implementations and the following detailed description thereof are merely exemplary aspects of the teachings of this disclosure and are not restrictive. As noted above, certain embodiments within the scope of this disclosure and the claims may not provide the particular advantages set forth above. That said, the most preferred embodiments provide many, most or all of the foregoing advantages relative to conventional heat-not-burn and vaping devices.

While certain embodiments have been described, these embodiments have been presented by way of example only, and are not intended to limit the scope of the present disclosures. Indeed, the novel methods, apparatuses and systems described herein can be embodied in a variety of other forms; furthermore, various omissions, substitutions and changes in the form of the methods, apparatuses and systems described herein can be made without departing from the spirit of the present disclosures. The accompanying claims and their equivalents are intended to cover such forms or modifications as would fall within the scope and spirit of the present disclosures.

What is claimed is:

1. A pod for use in a heat-not-burn tobacco aerosolization device, the pod comprising:

a container including one or more walls which at least partially define an interior volume;

a wet tobacco product disposed within the container, the wet tobacco product comprising at least about 65% glycerin by weight, at least about 5% water by weight, and at least about 15% tobacco by weight; and a heating element at least partially disposed within the container, the heating element being substantially surrounded by and in contact with the wet tobacco product;

wherein the pod is adapted to be received by a base unit and to receive from the base unit current to heat the heating element; and wherein the container, the wet tobacco product, and the heating element are configured such that, upon inhalation by a user, i) air flows across and in contact with a top surface of the wet tobacco product and at least a portion of the heating element, and ii) a liquid portion of the wet tobacco product is aerosolized by boiling the liquid portion in contact with the heating element.

2. The pod of claim 1, wherein the container, wet tobacco product and heating element are further configured such that a discrete solid portion of the wet tobacco product containing both glycerin and water is aerosolized at a temperature not exceeding about 140° C. as measured in the wet tobacco product 1 mm from the heating element.

3. The pod of claim 1, wherein the container includes walls configured to deform inwardly under negative inhalation pressure applied by the user.

4. The pod of claim 1, wherein the wet tobacco product has a jam-like consistency at room temperature.

5. The pod of claim 1, wherein the container, the wet tobacco product, and the heating element are configured to aerosolize the wet tobacco product at an efficiency of about 60 to 120 puffs per gram of the wet tobacco product.

6. The pod of claim 1, wherein the wet tobacco product is free of propylene glycol.

7. The pod of claim 1, wherein the container, the wet tobacco product, and the heating element are configured to generate an aerosolized inhalant adapted to be inhaled by the user through the pod, and wherein the aerosolized inhalant has at least six times less HPHCs than inhaled smoke of a 3R4F traditional cigarette.

8. The pod of claim 1, wherein the container, the wet tobacco product, and the heating element are configured to, during a heating cycle lasting about one to three seconds, aerosolize the wet tobacco product at a temperature not exceeding about 120° C. as measured in the wet tobacco 1 mm from the heating element.

9. A pod for use in a heat-not-burn tobacco aerosolization device, the pod comprising:

a container including one or more walls which at least partially define an interior volume;

a wet tobacco product disposed within the container, the wet tobacco product comprising at least about 65% glycerin by weight, at least about 5% water by weight, and at least about 15% tobacco by weight; and a heating element at least partially disposed within the container, the heating element being substantially surrounded by and in contact with the wet tobacco product;

wherein the pod is adapted to be received by a base unit and to receive from the base unit current to heat the heating element; and wherein the container, the wet tobacco product, and the heating element are configured to aerosolize the wet tobacco product to generate an aerosolized inhalant adapted to be inhaled by a user through the pod and wherein the aerosolized inhalant has at least six times less HPHCs than inhaled smoke of a 3R4F traditional cigarette.

10. The pod of claim 9, wherein the container, the wet tobacco product, and the heating element are configured such that, upon inhalation by the user, i) air flows across and in contact with a top surface of the wet tobacco product and at least a portion of the heating element, and ii) a liquid portion of the wet tobacco product is aerosolized by boiling the liquid portion in contact with the heating element.

11. The pod of claim 10, wherein the container, wet tobacco product, and heating element are further configured such that a discrete solid portion of the wet tobacco product containing both glycerin and water is aerosolized at a temperature not exceeding about 140° C. as measured in the wet tobacco product 1 mm from the heating element.

12. The pod of claim 9, wherein the wet tobacco product has a jam-like consistency at room temperature.

13. The pod of claim 9, wherein the container, the wet tobacco product, and the heating element are configured to aerosolize the wet tobacco product at an efficiency of about 60 to 120 puffs per gram of the wet tobacco product.

14. The pod of claim 9, wherein the wet tobacco product is free of propylene glycol.

15. The pod of claim 9, wherein the container, the wet tobacco product, and the heating element are configured to, during a heating cycle lasting about one to three seconds, aerosolize the wet tobacco product at a temperature not exceeding about 120° C. as measured in the wet tobacco 1 mm from the heating element.

16. A pod for use in a heat-not-burn tobacco aerosolization device, the pod comprising:

a container including one or more walls which at least partially define an interior volume;

a wet tobacco product disposed within the container, the wet tobacco product comprising at least about 65% glycerin by weight, at least about 5% water by weight, and at least about 15% tobacco by weight; and a heating element at least partially disposed within the container, the heating element being substantially surrounded by and in contact with the wet tobacco product;

wherein the pod is adapted to be received by a base unit and to receive from the base unit current to heat the heating element; and wherein the container, the wet tobacco product, and the heating element are configured to aerosolize the wet tobacco product at an efficiency of about 60 to 120 puffs per gram of the wet tobacco product.

17. The pod of claim 16, wherein the container, the wet tobacco product, and the heating element are configured to aerosolize the wet tobacco product to generate an aerosolized inhalant adapted to be inhaled by a user through the disposable tobacco delivery unit and wherein the aerosolized inhalant has at least six times less HPHCs than inhaled smoke of a 3R4F traditional cigarette.

18. The pod of claim 16, wherein the container, the wet tobacco product, and the heating element are configured such that, upon inhalation by the user, i) air flows across and in contact with a top surface of the wet tobacco product and at least a portion of the heating element, and ii) a liquid portion of the wet tobacco product is aerosolized by boiling the liquid portion in contact with the heating element.

19. The pod of claim 16, wherein the container, the wet tobacco product, and the heating element are configured to aerosolize the wet tobacco product at a temperature not exceeding about 140° C. as measured in the wet tobacco product 1 mm from the heating element.

20. The pod of claim 16, wherein the wet tobacco product has a jam-like consistency at room temperature.

* * * * *